US007477751B2

(12) United States Patent
Lyon et al.

(10) Patent No.: US 7,477,751 B2
(45) Date of Patent: Jan. 13, 2009

(54) METHOD AND APPARATUS FOR SOUND TRANSDUCTION WITH MINIMAL INTERFERENCE FROM BACKGROUND NOISE AND MINIMAL LOCAL ACOUSTIC RADIATION

(75) Inventors: Richard H. Lyon, Belmont, MA (US); David L. Bowen, Cambridge, MA (US); Gladys L. Unger, Belmont, MA (US)

(73) Assignee: RH Lyon Corp, Belmont, MA (US)

( * ) Notice: Subject to any disclaimer, the term of this patent is extended or adjusted under 35 U.S.C. 154(b) by 203 days.

(21) Appl. No.: 10/553,774

(22) PCT Filed: Apr. 22, 2004

(86) PCT No.: PCT/US2004/012363

§ 371 (c)(1),
(2), (4) Date: Aug. 10, 2006

(87) PCT Pub. No.: WO2004/095878

PCT Pub. Date: Nov. 4, 2004

(65) Prior Publication Data

US 2007/0086603 A1 Apr. 19, 2007

Related U.S. Application Data

(60) Provisional application No. 60/464,617, filed on Apr. 23, 2003.

(51) Int. Cl.
*H04R 3/00* (2006.01)

(52) U.S. Cl. ..... 381/96; 381/59; 381/92

(58) Field of Classification Search ..... 381/96, 381/92, 122, 59, 95, 71.1, 71.6, 26, 91, 93, 381/356; 379/406.05, 406.01, 406.06, 392.01, 379/388.07

See application file for complete search history.

(56) References Cited

U.S. PATENT DOCUMENTS 4,489,441 A 12/1984 Chaplin (Continued)

*Primary Examiner*—Vivian Chin
*Assistant Examiner*—Disler Paul
(74) *Attorney, Agent, or Firm*—Steven J. Weissburg

(57) ABSTRACT

A transducer senses sounds produced by a talker or other source and measures acceleration of air. Enhancement of acceleration is accompanied by reduction of the portion of the sound energy that escapes from the regions around the transducer. The result is a high sensitivity transducer, with increased privacy for use in communication systems, especially cell phones and in a multi-person environment. A pressure sensor array with a weighted output is sensitive to sound from a source talker only, and not to acoustic background noise, and not to a local loudspeaker. The weighted signal is a source sum pressure signal. The array produces a signal (using a different weighting) that corresponds to an estimate of a derivative of pressure. The derivative signal is proportional to the volume velocity fluctuations produced by the source. This signal is enhanced, rather than reduced. A local loudspeaker is driven to make the source sum pressure signal as small as desired. The loudspeaker is driven to produce volume velocity fluctuations approximately equal and opposite to those produced by the source. No compression of air arises due to the talker, and no sound is radiated into the far field. All happens because the system is driven to reduce the source pressure sum signal to below a desired threshold. It is not necessary to directly measure the volume velocity fluctuations of the talker source.

27 Claims, 14 Drawing Sheets

U.S. PATENT DOCUMENTS 4,527,282 A 7/1985 Chaplin et al.
4,752,961 A 6/1988 Kahn
5,046,103 A 9/1991 Warnaka et al.
5,121,426 A 6/1992 Baumhauer, Jr. et al.
5,303,307 A * 4/1994 Elko et al. ..... 381/92
5,381,473 A * 1/1995 Andrea et al. ..... 379/388.03
5,396,554 A * 3/1995 Hirano et al. ..... 379/406.08
5,402,669 A 4/1995 Pla et al.
5,463,893 A 11/1995 Pla et al.
5,479,813 A 1/1996 Pla et al.
5,561,737 A 10/1996 Bowen
5,625,684 A 4/1997 Matouk et al.
5,625,697 A 4/1997 Bowen et al.
5,673,326 A * 9/1997 Goldfarb ..... 381/99
5,812,686 A 9/1998 Hobelsberger
5,824,892 A 10/1998 Ishii
5,914,912 A 6/1999 Yang
5,937,070 A * 8/1999 Todter et al. ..... 381/71.6
6,016,351 A * 1/2000 Raida et al. ..... 381/77
6,085,078 A 7/2000 Stamegna
6,160,892 A 12/2000 Ver
6,393,130 B1 5/2002 Stonikas et al.
6,408,078 B1 6/2002 Hobelsberger
6,947,570 B2 * 9/2005 Maisano ..... 381/313
6,952,474 B2 10/2005 Wittke et al.
7,272,234 B2 * 9/2007 Sommerfeldt et al. .... 381/71.11
2002/0009203 A1 1/2002 Erten
2003/0044025 A1 3/2003 Ouyang et al.

* cited by examiner

METHOD AND APPARATUS FOR SOUND TRANSDUCTION WITH MINIMAL INTERFERENCE FROM BACKGROUND NOISE AND MINIMAL LOCAL ACOUSTIC RADIATION

RELATED DOCUMENTS

The benefit of U.S. Provisional application No. 60/464,617, filed on Apr. 23, 2003, is hereby claimed.

A partial summary is provided below, preceding the claims.

The inventions disclosed herein will be understood with regard to the following description, appended claims and accompanying drawings, where:

NOMENCLATURE

The following symbols and abbreviations are used herein:

a(t) acceleration of air particles as a function of time;

ρ density of acoustic medium;

$p_1$, $p_2$ sound pressure; if lower case, in the time domain, if upper case, in the frequency domain;

$p_t$ sum of sound pressure attributable to talker or source of interest, which can be weighted which weighting should be regarded as a frequency domain procedure, even though in some cases the weighting is multiplication by a constant;

Δp estimation of spatial derivative of sound pressure,;

dp/dx spatial derivative of sound pressure along x dimension;

ϵ maximum threshold against which to minimize $p_t$;

$U_L$ acoustic signal (volume velocity) from loudspeaker;

$U_T$ acoustic signal (volume velocity) from talker;

$V_L$ electronic signal to drive loudspeaker;

λ wavelength of sound;

$D_{LMb}$ separation loudspeaker to nearest microphone;

$D_{TMa}$ separation from talker to nearest microphone;

d separation from talker to loudspeaker;

h separation between adjacent microphones

β 2πd/λ;

K(z) frequency dependent gain of adaptive filter;

DETAILED DESCRIPTION

Figure 1:
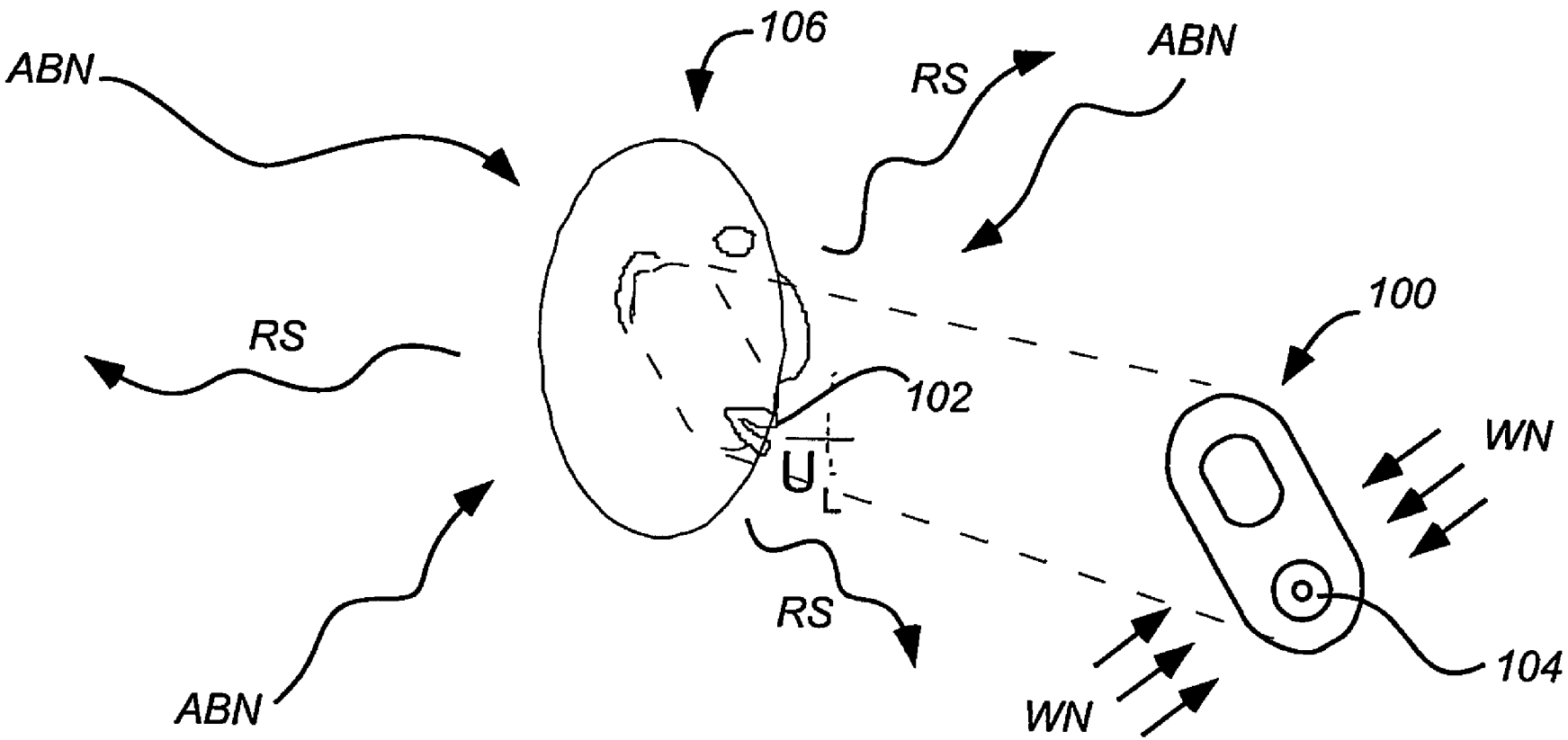
Fig. 1 Prior Art
FIG. 1 is a schematic representation of a prior art hand held transceiver and a talker, showing acoustic background noise and radiated sound.

Three design problems are inherent in telephonic and other communications systems that have as a goal, transduction and transmission of sound produced by a source, particularly a human talker. These difficulties are shown schematically with reference to FIG. 1, a schematic of a talker 106 using a conventional handheld transducer 100. The difficulties include: (1) sensitivity to acoustical background noise (ABN) that interferes with understanding; (2) limited privacy, due to radiation of sound (RS) to others in the local environment of the talker, allowing them to overhear what the talker has said; and (3) sensitivity to wind noise WN produced primarily by locally generated turbulence. The sensitivity to background noise and privacy/radiation problems are closely related although not identical. If the talker's lips 102 are very close to a transducer microphone 104, these two concerns may be related through reciprocity. Namely, if sound (e.g. acoustic background noise) is well received from a given direction, sound will, by reciprocity, be well radiated back into that same direction (e.g. as radiated sound).

Military and industrial systems in general have the background noise problem, because they often operate in regions of high noise level. Cell phones and other telephonic, or handheld communication systems, such as short range radio transceivers, for which privacy is an issue, often have the sound radiation problem.

Noise due to turbulence WN is usually addressed by surrounding a pickup transducer, such as a microphone, with a windscreen. Windscreens are commonly made from a porous (open cell) plastic foam material. These windscreens can be effective, but their potentially large size can be a problem. Further, in a high wind, they lose their effectiveness. Microphone arrays can also reduce sensitivity to local pressure fluctuations produced by turbulence, but at a penalty related to overall transducer size, complexity, and cost.

As cellular phones become more widely used, the need to reduce both the acoustic noise and radiated sound problems is increasing. People are becoming more dependant on being able to use their cellular phones in less traditional places, including those that are noisier than a typical indoor landline telephone environment, such as, outdoors, near to road traffic; in automobiles with road and wind noise, in crowded public places, full of the sounds of other people's conversations (many on their cellular telephones); in airplanes, trains, hospitals, and from emergency situations. Similarly, people are also using cellular telephones from locations that have traditionally been free of the sort of potentially private, or inappropriate conversations that people have on telephones, such as are now being heard in restaurants, libraries, theaters, museums, hospitals, schools, multi user offices, doctors' offices, trains, airplanes, etc.

Related to the radiation problem is that a cellular phone talker may often not realize that he or she is speaking much louder than necessary, and whether necessary or not, much louder than others nearby would wish. The same observations apply to the use of other forms of handheld communication devices, such as short and medium range radio transmitters of the Family Radio Service (FRS) type, or walkie-talkies, which are common, although not as of this writing as common as cellular telephones. In addition to hand-held, head mounted communication devices, such as the headsets used by National Football League coaches, available from Motorola corporation, which include a head band and a boom mounted microphone, also are appropriate subjects for inventions hereof. Another system that suffers from the same problems are local public address systems, in which a talker speaks or sings into a microphone, which signal is then transmitted to a loudspeaker or loudspeakers, which convey the spoken amplified sound to an audience in an auditorium or stadium.

Thus, there is a great need for a handheld communication system that can reduce the sensitivity of any transmitted electronic signal to acoustic background noise. Similarly, there is a need for such a handheld communication system that can reduce the sensitivity of any transmitted electronic signal to local turbulent noise. Additionally, there is a significant need for such a handheld communication system that exhibits reduced radiated sound from the user/talker to the talker's local environment, particularly, to nearby people.

SUMMARY

A new transducer is disclosed herein for sensing sounds produced by a talker by measuring the acceleration of the air at the transducer. Further, enhancement of this acceleration is accompanied by reduction of the portion of the sound energy that escapes from the regions around the transducer. The result is a high sensitivity transducer, with increased privacy as a result of the reduction in radiated sound, with significant advantages for use in communication systems, especially cell phones and in a multi-person office environment. A pressure sensor array with a weighted output is designed to as much as possible be sensitive to sound from a source talker only, and not to acoustic background noise, and not to a local loudspeaker, mentioned below. The weighted signal is a source/talker sum pressure signal. The array also produces a signal (using a different weighting) that corresponds to an estimate of a derivative of pressure. The derivative signal is proportional to the volume velocity fluctuations produced by the source. This signal is enhanced, rather than reduced, by other operations of the transducer described below. Thus, it is a strong signal. The other operations are that a local loudspeaker is driven to make the talker sum pressure signal that corresponds to the source talker as small as desired. In order to do that, it must be so that the loudspeaker is being driven such that the volume velocity fluctuations produced by the loudspeaker are approximately equal and opposite to the volume velocity fluctuations produced by the source talker. Thus, no compression of the air arises due to the talker, and no sound is radiated into the far field. All of this happens because the system is driven to reduce the talker pressure sum signal to below a desired threshold. It is not necessary to directly measure the volume velocity fluctuations of the talker source.

DETAILED DISCUSSION

Figure 2:
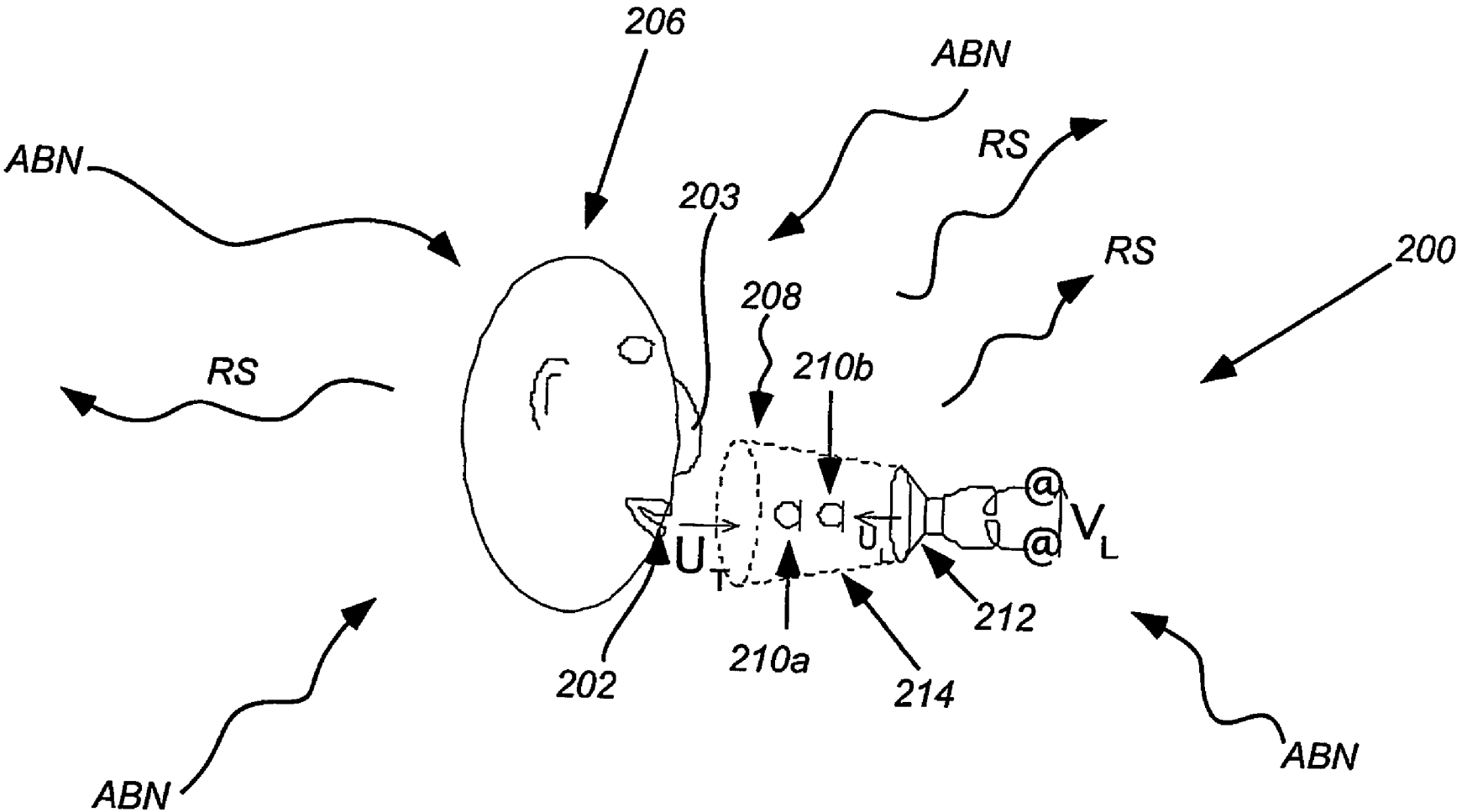
FIG. 2 is a schematic representation of an embodiment of a hand held transceiver of an invention hereof and a talker.

A conventional microphone measures sound pressure (the fluctuating part of the fluid pressure due to fluid compression) at its location. For purposes of illustration, the following discussion pertains to sound production in air. However, inventions disclosed herein may also be practiced in other fluid media for acoustic transmission, such as relatively compressible gases or in relatively incompressible liquids such as water. An invention hereof, schematically illustrated with reference to FIG. 2, is the realization that a transducer 200 that measures and also significantly enhances the acceleration of air particles in front of a talker's mouth 202, as compared to the talker alone, rather than simply measuring air pressure, provides advantageous results. Such an acceleration based transducer 200 can be configured to be most sensitive to sound produced by the talker 206 as compared to other acoustic background noise (ABN), and also to reduce, radiated sound (RS) that would otherwise radiate away from the talker 206 alone and be heard by others. A general representative layout of an embodiment of a transducer's components is illustrated in FIG. 2.

A microphone array 208 consists of two or more closely spaced microphones 210*a* and 210*b*. (An additional embodiment, having only a single microphone, is discussed below.)

The transducer also includes a loudspeaker 212. The loudspeaker is different from a standard ear-piece loudspeaker for producing the sound of incoming calls to which a user listens. The loudspeaker used in the present inventions is nearer to a user's mouth than to the user's ear, when the device is in use. The lips 202 and nose 203 of a talker 206 produce volume velocity $U_T$ that is subsequently drawn in by the loudspeaker 212. If the microphones 210*a*, 210*b*, . . . 210*n* are close together (within about one-sixth of a wavelength of sound at the highest frequency of interest), then inertial effects of the air (represented by an acoustic mass) dominate the pressure difference between the microphones. (The frequency range of interest for an important embodiment of inventions disclosed herein is that of human speech, from about 200 Hz to about 3000 Hz, with corresponding wavelengths of between 180 cm and 12 cm and therefore, the length of ⅙ the shortest wavelength is less than 2 cm.) It is also important that the distance $D_{LMb}$ between the loudspeaker and the closest microphone (See FIG. 5) be less than about one-sixth this wavelength, so that inertial effects dominate the region. For the same reason it is beneficial, although not as critical, that the distance $D_{TMa}$ between the talker and the nearest microphone also be less than the same measure. Although one-sixth the smallest wavelength is the theoretical limit for inertial effects, it is not a bright-line boundary, and some benefit may be achieved if the relevant distances are slightly larger than the ⅙ wavelength stated measure, even up to as large as one-third the smallest wavelength in some cases.

If the loudspeaker 212 draws in volume velocity fluctuations $U_L$ at the same rate as the talker produces volume velocity fluctuations $U_T$, then the pressure, and consequently, the compression of the air at the array, is reduced significantly as compared to the compression that would exist in the presence of the talker alone. Therefore, the sound produced, that is, the sound pressure, radiated away from the talker/loudspeaker complex, will be relatively weak, as compared to the sound pressure that would be produced by the talker 206 alone. This is because volume velocity fluctuations do not escape the locus of the transducer to produce sound RS that is radiated away from the talker 206. Basically, the volume velocity fluctuations from the loudspeaker combine with that from the talker and prevents the compression of air in the near (inertial) field and any consequent radiation of sound. Conversely, under these circumstances, the pressure gradient, and thus the pressure derivative along a line from the talker to the loudspeaker at the microphone array, is increased, as compared to what would exist with a talker alone.

Although the sound pressure and air compression at the array are significantly reduced, the air in the immediate region between the talker and the loudspeaker, namely, in the locus of the transducer array 208, is accelerated to a degree that is proportional to the pressure derivative along a line, at this locus. The temporal variations in air acceleration and in pressure derivative also correspond proportionally to the sound signal generated by the talker, in a manner similar to that of uncancelled sound pressure. Thus, to embody the signal that signifies the spoken sounds to be communicated, it is not necessary to measure sound pressure, which has been significantly reduced, and transduce that measured, reduced pressure into an electronic signal that is then transmitted. Rather, an embodiment of an invention hereof measures variation over time in air acceleration along a line from talker to loudspeaker and transduces that variation into an electronic signal that is transmitted to embody the signal that signifies the spoken sounds to be communicated.

Acceleration can be measured directly in any appropriate way, such as by laser doppler, or, it can be inferred, such as by estimating a derivative of pressure, to which acceleration is proportional, related by density of the medium. The appropriate derivative is that along the line from the talker to the loudspeaker. At the time, of this writing, it is believed that it is more practical to infer acceleration from measured or estimated pressure derivative, than to measure acceleration more directly. Thus, the following discussion focuses on measuring and using pressure derivative data, using spaced microphones. However, it should be understood that acceleration data can be more directly measured and used analogously.

A spatial pressure derivative signal would be estimable even if the acoustic medium were much less compressible than air, such as is water. That allows an embodiment of an invention hereof to be used in water and further is an important factor in reduced sensitivity to ambient sounds of a system that transmits a signal based on a pressure spatial derivative and reduction of radiated sound.

This is because, although strictly speaking, sound pressure refers to that part of the fluctuating pressure that is produced by air compression, an incompressible time varying flow will not have compression, but will have a fluctuating pressure that could be heard if one's ear were to be in the midst of it. From the point of view of physics, the incompressible fluid does not carry sound waves, but from the perceptual point of view, it is-appropriate to call it sound. A compressible fluid carries both types of fluctuation. An invention hereof tries to keep the compressible part from being generated by sucking up the air-flow from the talker and creating a local incompressible flow between the talker and the loudspeaker, measured by the microphones, through the pressure derivative of the flow.

A transducer of an invention hereof deliberately reduces the radiated sound pressure produced by the talker, while it increases the oscillatory, back and forth, or sloshing flow of air past the microphone pair 210*a*, 210*b*, and thus, increases the pressure derivative. Known pressure gradient microphones also measure the acceleration of the air. But, they do not also increase the acceleration and reduce compression and they do not use a local loudspeaker, as does an invention hereof.

Figure 3B:
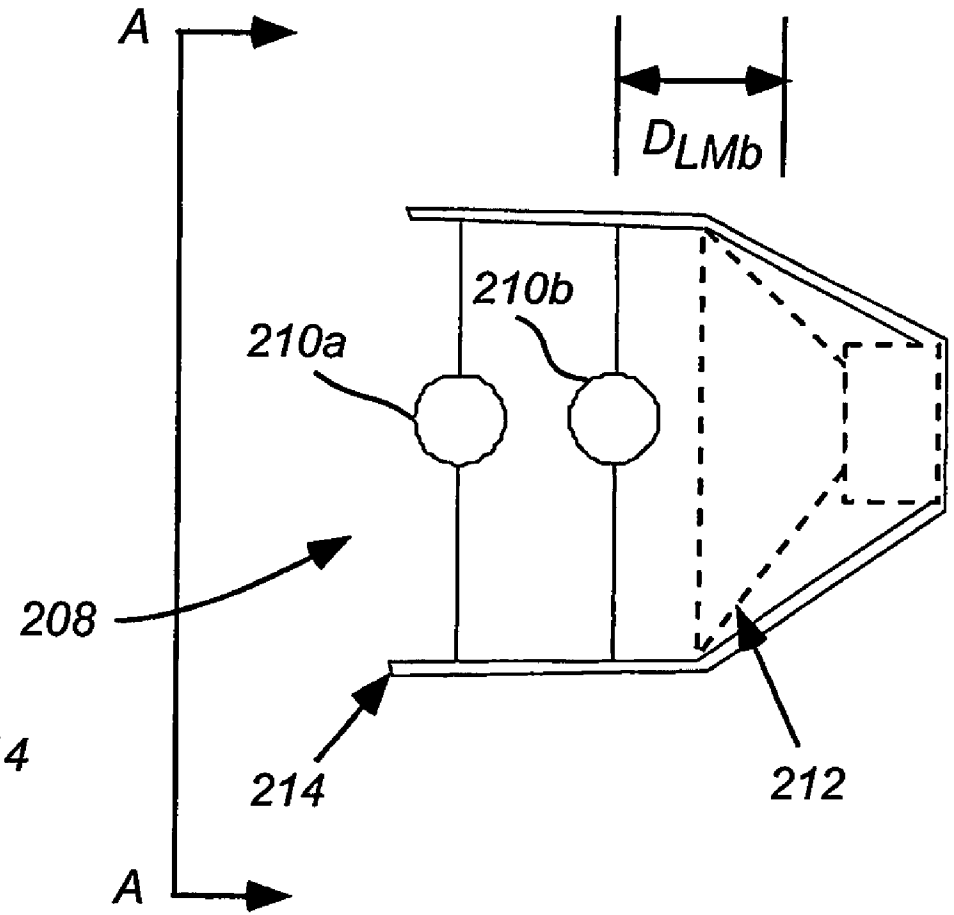
FIG. 3B is a cross-sectional view across the lines BB of FIG. 3A, of a microphone pair and loudspeaker assembly of an embodiment of a hand held transceiver of an invention hereof.
Figure 3A:
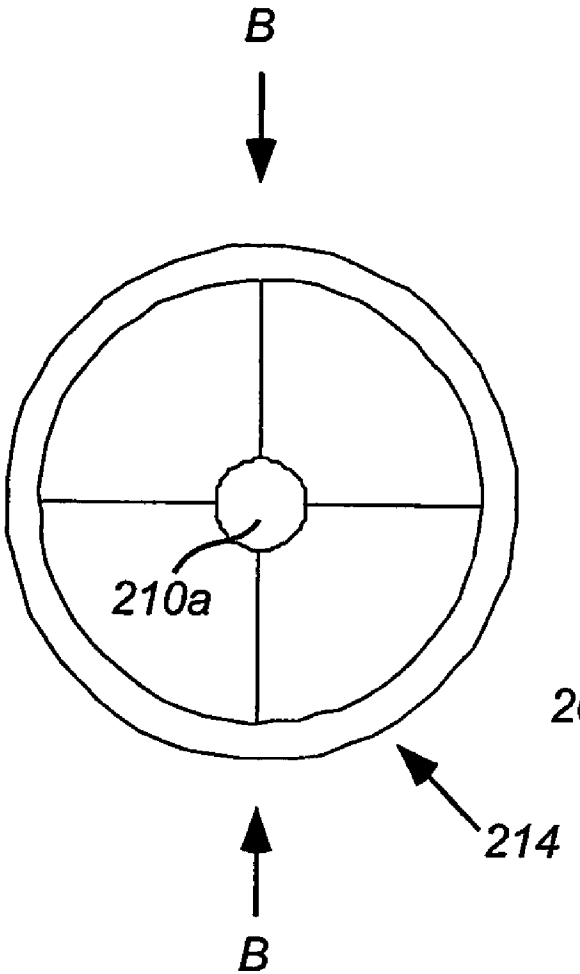
FIG. 3A is an end view from the lines AA of FIG. 3B, of a microphone pair and loudspeaker assembly of an embodiment of a hand held transceiver of an invention hereof.

To increase noise immunity from turbulent airflow in the immediate vicinity of the microphone array 208, a shroud 214 such as the one shown in FIG. 2, and in FIGS. 3A and 3B, can be incorporated into a handheld transducer. (The shroud also can reduce sensitivity to ambient noise.) A shroud 214 can be optimized to reduce the effects of turbulence. A porous foam windscreen can also be incorporated into this transducer. FIG. 3A is an end view of the embodiment shown in FIG. 3B, from arrows A-A. FIG. 3B is a cross-section of the embodiment shown in FIG. 3A, along the lines BB.

Analysis and Operation

Figure 4:
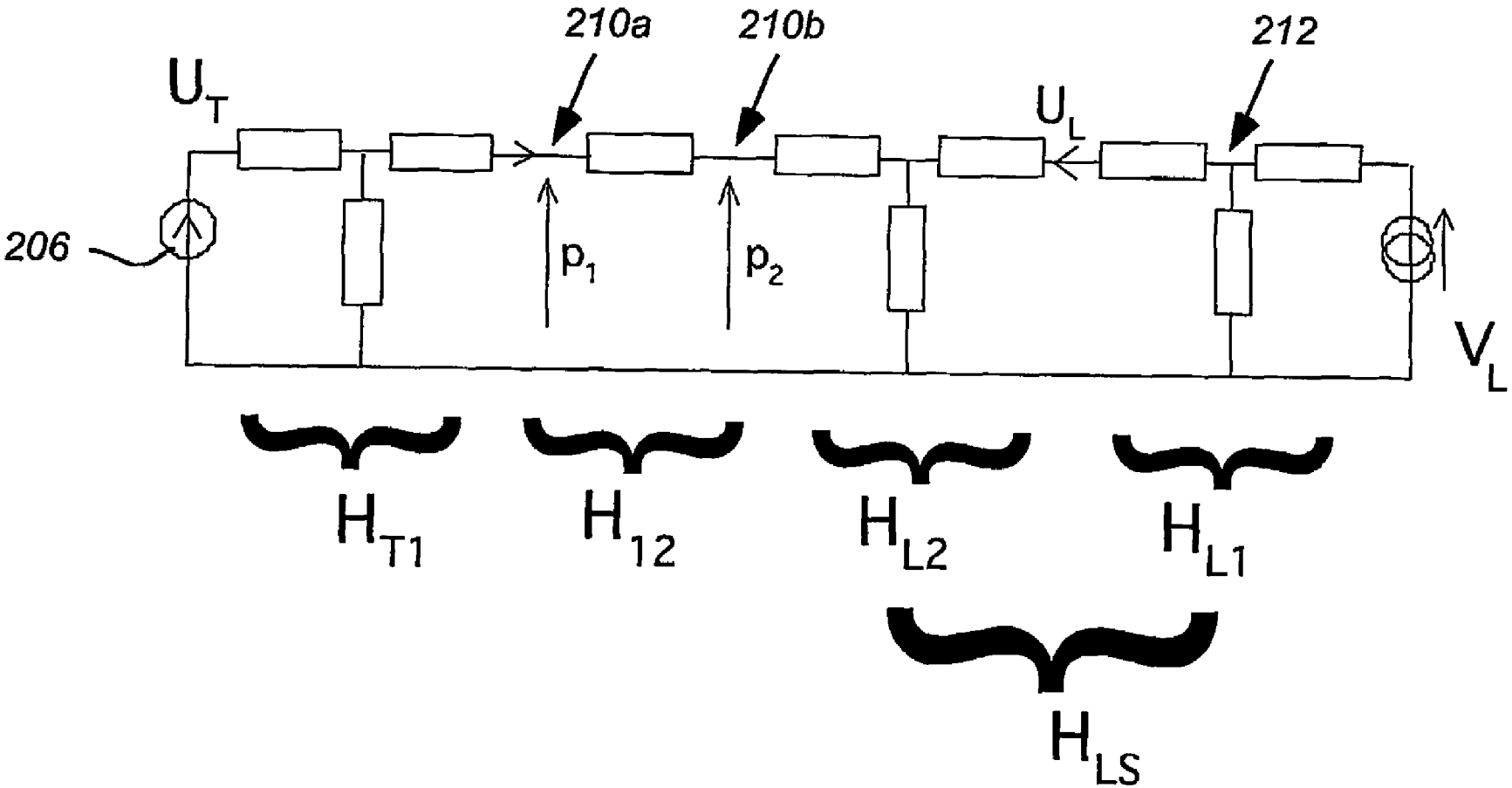
FIG. 4 is a schematic representation of system elements of an electro-acoustical circuit including a talker, a power source that drives a loudspeaker and a microphone array.

A schematic representation of acoustic elements of one embodiment of a transducer system of an invention hereof is shown in FIG. 4 which corresponds also to the elements shown in FIG. 2. The diagram of FIG. 4 is an electro-acoustic circuit, since it involves both electrical and acoustical variables. The physical transducer elements for the embodiment shown are a pair of microphones 210*a*, 210*b* that measure sound pressure and a small loudspeaker 212. The loudspeaker 212 is driven by an electrical signal $V_L$, as discussed below, proportional to a difference in outputs from the microphones 210*a* and 210*b* in such a way that also leads to significantly reducing a pressure quantity $p_t$ that is attributable to the talker, as measured by a sum of the microphone outputs, also discussed below. Both the difference and the sum may be simple, or weighted, also as discussed below. In general, the symbol $\Delta p$ is used below to indicate an estimate of a pressure derivative. Thus, in general, $\Delta p$ is an estimate of spatial derivative $dp/dx$, based on microphone weightings.

The talker 206 generates an acoustic volume velocity signal $U_T$ that is transmitted through the air to one microphone 210*a* of the array. The transmission is characterized by a T-shaped network $H_{T1}$. Pressure at that microphone being represented as $p_1$. The flow disturbance due to $U_T$ that originates at the talker is transmitted further to the second microphone 210*b* of the pair, the transmission characterized by a transmission element $H_{12}$ the pressure at that second microphone being represented as $p_2$.

A transducer (in this case a loudspeaker 212) is incorporated into such a circuit diagram as a T-shaped network $H_{L1}$, which represents the electronic-to-acoustic transduction elements, and a T-shaped network $H_{L2}$, which represents the transmission from the acoustical output of the loudspeaker, through air, to the closest, nominally second microphone, 210*b*. The composite electro-acoustical transmission element $H_{LS}$, which includes the two elements $H_{L1}$ and $H_{L2}$, represents the electronic and acoustic elements of the loudspeaker and transmission through the acoustic medium to the second microphone 210*b*. The acoustic signal $U_L$, originating at the loudspeaker 212, is also transmitted through the acoustic medium, e.g., air to the first mentioned microphone 210*a*. The transmission is also characterized by the same acoustic network element $H_{12}$, and also contributes to the pressure $p_1$ at that first mentioned microphone 210*a*. The network element $H_{12}$ characterizes transmission through the air between the microphones, in either direction.

The loudspeaker electric input signal $V_L$, is selected in a manner discussed below, to generate an acoustic loudspeaker output signal $U_L$ that will minimize or at least reduce below a threshold, $\epsilon$ the sum $p_t$ of the pressures $p_1$ and $p_2$ for this basic two microphone array. Such minimization, or reduction, will automatically increase an estimate of pressure derivative signal $\Delta p$, which can be transmitted to a remote receiver. The manner in which the talker pressure sum signal $p_t$ is composed from the microphone signals (by which it is meant the microphone weightings in the sum) has a dominating effect on the directional sensitivity of the microphone array. Thus, the manner in which the talker pressure sum $p_t$ is composed can be chosen to reduce or minimize, the signal due to ambient sources other than the talker. Combining signals from a microphone array to enhance directivity toward a talker and combining those signals to extract the estimate of pressure derivative $\Delta p$, is discussed below.

It is an invention hereof to use a signal that is reduced or even minimized, such as $p_t$, to establish directional sensitivity of a system, and of a signal to be transmitted.

The temporal acceleration a(t) of air along the line joining the two microphones, for a two microphone array as shown, is given by:

$$a(t) = -\frac{1}{\rho}\frac{dp}{dx} \quad \text{(Eq. 1a)}$$

where $\rho$ is the density of air and p is sound pressure. The derivative is along the line joining the two microphones. With only two microphones, the derivative can be estimated, as:

$$a(t) = -\frac{1}{\rho}\frac{dp}{dx} \approx (p_1 - p_2)/\rho\Delta x, \quad \text{(Eq. 1b)}$$

where $\Delta x$ is the distance between the microphones and $p_1$ and $p_2$ are the sound pressures measured at each microphone.

(This relationship is altered when turbulence is present as discussed below).

It is generally desirable that the line joining the two microphones be as coincident as possible with a line joining the talker's mouth and the loudspeaker.

In general, any loudspeaker used and the talker can each be considered to be an acoustic point source, such that sound pressure produced by each radiates away equally in all directions, namely with little directionality. The handset of a device, such as a cell phone, generally has a talker signal input region, located to encourage the talker to orient the handset so that the talker's mouth, the microphone array and the loudspeaker, all lie along a substantially straight line.

If an array of more than two microphones is employed, their outputs are still combined as $p_t$ in such a way so that a talker pressure sum $p_t$ is to be significantly reduced by minimization, while a pressure derivative estimated as $\Delta p$ is simultaneously significantly increased. Typically, the microphones of the array are arranged along a line. The estimate of derivative $\Delta p$ is proportional to the derivative along this line. If the microphones are not arranged all in a line, then the estimate of derivative $\Delta p$ is along some appropriate line that passes through the array of microphones, and also typically includes the loudspeaker, and talker input portion of the transducer housing. As noted above, with an array of two or more microphones, there are choices as to how the microphone outputs are combined to produce a talker sum $p_t$ and an estimate of derivative $\Delta p$ at the array. For example, different weights may be assigned to different microphone outputs. One suitable choice is discussed below.

The system therefore increases the acceleration of the air in the region between the talker's lips 202 and the loud speaker 212, above that which would be present and sensed by an ordinary velocity or pressure gradient microphone without a loudspeaker. Specifically, the system increases the acceleration over what would be measured by a ribbon microphone that measures acceleration or pressure gradient, but which does not introduce additional volume velocity into the system by way of a loudspeaker. At the same time, a system of an invention hereof significantly reduces the compression of the air in the region between the talker's lips and the loudspeaker.

These inventions have been demonstrated by: (1) modeling the acoustical processes involved, (2) constructing a prototype demonstration, and (3) incorporating the appropriate signal processing routines (in this case, taking sum and difference signals from the microphones) and (4) testing for immunity to ambient acoustical noise and reducing the sound radiated away from the talker.

Figure 5:
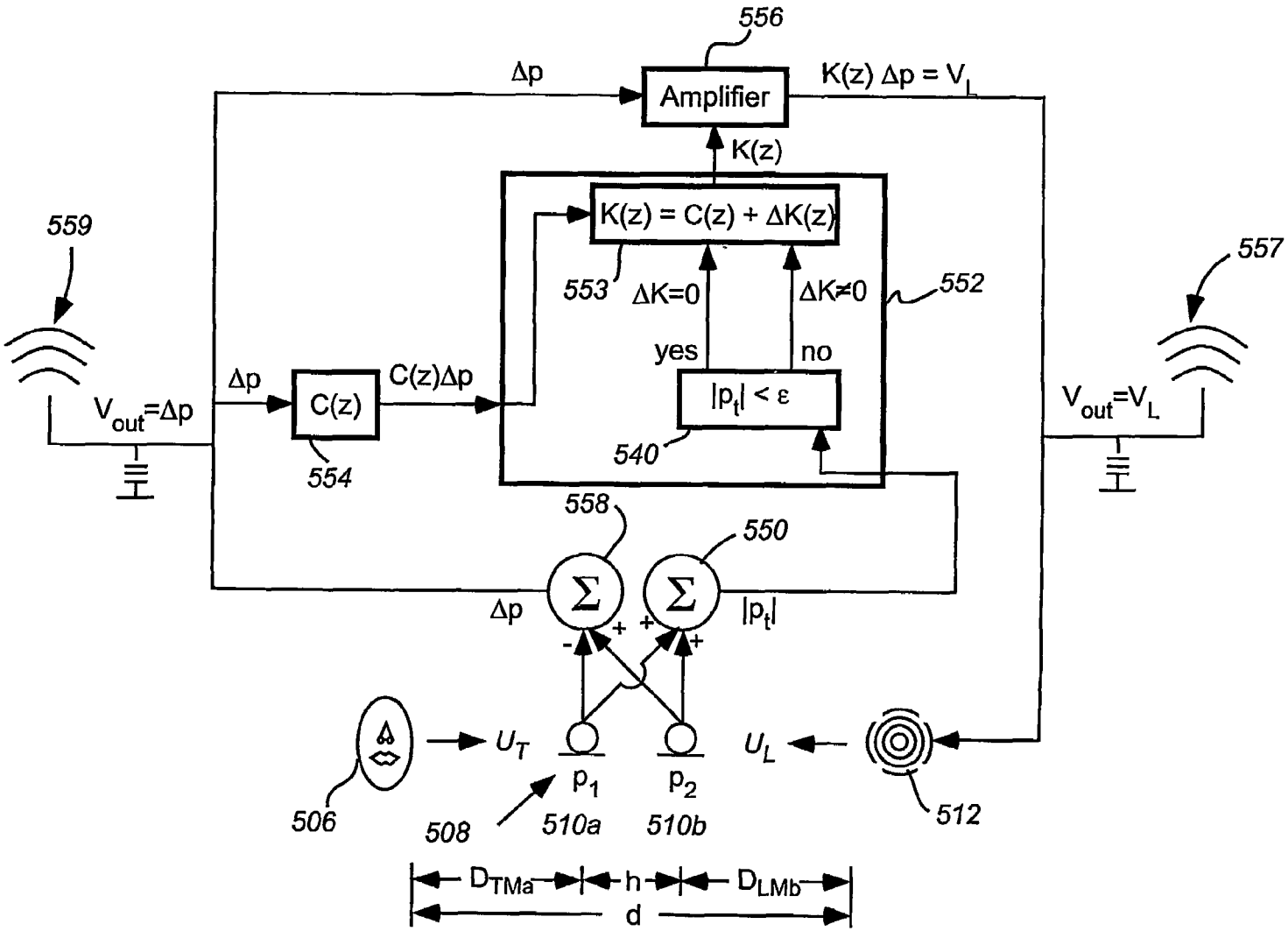
FIG. 5 shows schematically hardware and a routine for adaptively updating variable coefficient filter of an invention hereof.

FIG. 5 shows schematically hardware elements and indicates processing steps that take place in some of those elements. Most of these elements can be individual elements, or can be implemented as part of a digital signal processor, or an analog processor or as a custom designed processor or semiconductor assembly. The ordinarily skilled designer can make an appropriate choice of hardware depending on cost, speed and size requirements and available hardware.

At least two microphones 510*a* and 510*b* of an array 508 are arranged near to a loudspeaker 512. Typically, the loudspeaker is in line with the two microphones, or, if more than two, with a characteristic acoustic axis of the microphone array. The microphones sense the sound pressures $p_1$ and $p_2$ in their local environment and generate electronic signals that correspond thereto. The signals from both microphones are combined at a summer 550, which outputs a talker pressure sum signal $p_t$ that corresponds to a sum of the pressures. If only two microphones are used, $p_t$ can be a simple sum or a more complicated weighted combination sum. If more than two are used, it is also a more complicated weighted combination, as discussed below.

The signals from both microphones are also compared at comparator 558 which generates an estimate of derivative signal $\Delta p$ that corresponds to the derivative of the pressure. If only two microphones are used, this comparison generates a signal that corresponds to $p_1$-$p_2$ If an array of more than two microphones is used, then a more complicated, weighted combination is used to estimate the difference signal, as discussed below.

In general, it is desired to drive the loudspeaker 512 with a signal $V_L$ that is proportional to the estimate of derivative $\Delta p$, but with a degree of proportionality K(z) that reduces the talker pressure sum $p_t$ to below a threshold amount $\epsilon$ that has been determined to be acceptable. (The reasons for this are discussed below in connection with FIG. 13.)

Turning first to the comparator 558 and an estimate of pressure derivative signal $\Delta p$, there are delays and other transfer path distortions introduced by the physical systems between the electrical signal input $V_L$ to the loudspeaker 512 and the corresponding microphone output signals. To compensate for these delays and distortions, the signal $\Delta p$ to be used as a reference is first filtered 554 with an estimate C(z) of this transmission delay. The estimate of derivative signal is input to a pre-filter 554 which generates a reference signal C(z)Δp. This reference signal C(z)Δp is input to the adaptive routine conducted in processor 552 described above. Such a pre-filter estimate C(z) can be derived from a transfer function measurement made between the voltage $V_L$ and the microphone outputs when $V_L$ is replaced with broadband noise, while the transducer is held close to a user's mouth without the user talking. For example, low amplitude pseudo-random noise can be fed continuously or periodically to the loudspeaker for the determination of this transfer function delay.

Turning next to another aspect of establishing the degree of proportionality K(z), an adaptive filter coefficient generator 552 further helps to establish the degree of proportionality. It takes as an input the talker pressure sum signal $p_t$ and, in a comparator 540; compares that sum to the predetermined threshold amount ϵ. The threshold ϵ is simply an amount that has been determined in advance, to be small enough so that the total radiated sound pressure is small enough to be acceptable. It may be different for different applications. For instance, for normal telephonic use, it need not be as small as for espionage equipment.

If the absolute value of the pressure sum $|p_t|$ is less than ϵ, then the loudspeaker 512 is generating an acceptable signal, and the filter coefficients K(z) are fine and need-not be changed and ΔK=0. If, however, the absolute value of the pressure sum is greater than ϵ, then an adapter 553 portion of coefficient generator 552 changes the filter coefficients based on a non-zero change factor ΔK. This. ΔK is provided to change the gain K(z) of the amplifier 556. FIG. 5 shows simply adding ΔK(z) to C(z), however, this is only a schematic suggestion. In general, K(z) is based on a function of both C(z) and ΔK(z), in some appropriate fashion. An important reason for providing C(z) separately is to simplify K(z). In practice K(z) would get updated at a processing clock rate, on the order of at least 1 KHz, while C(z) might get updated at only 5 or 10 Hz.

Thus, the estimate of derivative signal Δp is fed to an amplifier 556, which has a variable gain K(z), which is adaptively varied as discussed above, in general, and below in slightly more detail for a specific embodiment. The amplifier 556 outputs a signal K(z) Δp, which generates the input $V_L$ to the loudspeaker 512.

The analytical model shown in FIG. 4 can be used to develop an optimization approach accomplished by the elements shown in FIG. 5. The technique may be based on a time-domain adaptive approach, using a variant of a normalized filtered-x LMS routine, such as is explained in the following three papers, all of which are incorporated fully herein by reference: D. R. Morgan (1980), "An analysis of multiple cancellation loops with a filter in the auxiliary path," *IEEE Transactions on Acoustics, Speech and Signal Processing*, ASSP-28, pp. 454-467; B. Widrow, R. G. Winter, R. A. Baxter (1981), "On adaptive inverse control," *Proc. 15th ASILOMAR Conference on Circuits, Systems and Computers*, pp. 185-195 (feedforward control); J. C. Burgess (1981), "Active adaptive sound control in a duct: a computer simulation," *Journal of the Acoustical Society of America,* 70, pp. 715-726 (active control of sound in ducts).

(Other approaches, such as using direct minimization of $|p_t|$ and enhancement of Δp, via modifications of K, with appropriate constraints imposed, are possible if a detailed enough model is available).

FIG. 5 represents one embodiment of an invention hereof using digital signal processing of the data. A suitable algorithm is known as a filtered x- LMS routine, referred to above. The filter to be optimized for the minimization of $|p_t|$ is (in z-transform notation):

$$K(z) = \sum_{n=0}^{n=1} w_n z^n, \qquad \text{(Eq. 1c)}$$

where typically n=32. At each time step i the weights $w_n$ are adjusted by an amount:

$$\Delta w_n(i) = A \times |p_t^{(i-1)}| \times \sum_{k=0}^{M} \{c(k)\Delta p(i-n-k-1)\} \qquad \text{(Eq. 1d)}$$

where $p_t(i)$ and Δp(j) are the time sampled values of these quantities as measured by the microphone array and A is a constant chosen to make the optimization proceed more quickly. The order M filter C(z) represents an estimate of the transfer function between the voltage $V_L$ applied to the loudspeaker and the Δp signal as measured by the array 508. The values c(k) are the inverse z transform of C(z) described above, and represent the time sampled values of that filter's impulse response. The function C(z) can be measured as part of a calibration process as noted above or estimated, in some cases as a simple delay of M time samples $C(z) \sim 1/z^M$.

To understand how fast the updating should occur, the loudspeaker 214 should beneficially enhance the acceleration at the microphone array 208 until the pressure sum at the array is reduced to an acceptably small amount. The loudspeaker and its driving electronics must therefore be able to react to signals (generate sound in response to sound produced by the talker) within 15-20% of the period of the highest frequency of interest. Typically, the output from the pressure sensors should be sampled at a frequency of at least 2.4 times the highest frequency of interest and, in some cases, involving a time delay, discussed below, at least 6 times. This is a 'standard understanding for sampling rate based on the highest frequency of interest. Experience with telephonic transmission indicates that this system needs to be effective over a frequency range from about 200 to 3000 Hz. Delays in the system, including electrical, mechanical, and acoustical should be minimized as much as possible. The analytical model is very useful for this minimization.

For example, sbund travels about 35 mm in 100 μsec. Assuming, for purposes of this illustration that the longest propagation delay that the designer wants to tolerate is 0.2 periods at 2000 Hz, which equals 200 μsec. Then the upper limit of the distance Da between the loudspeaker and the closest microphone of the array is limited to about 35 mm (1.85 in). There is no corresponding restriction on the maximum distance $D_{TMa}$ between the talker 206 and the closest microphone of the array 208, from the standpoint of enhancing the local acceleration at the array. Delay between the time of actual speech production and its arrival at the microphone array 208 should not affect the enhancement in pressure derivative at the array or immunity from ambient sound and sensitivity to speech from the talker, although it may reduce privacy.

An informative simulation of this approach using transient signals such as those found in speech, with a microphone spacing h of 2 cm and a filter K(z) with thirty-two coefficients, results in an overall reduction of approximately 11 dB in the talker pressure sum and an overall increase of about 8 dB in the estimate of pressure derivative (as compared to a talker alone). Values of these changes are consistent with the contours for radiated sound in FIG. 13 and pressure gradient enhancement in FIG. 14 (discussed below). While these results indicate the performance that may theoretically be achieved using this approach, the performance of a physical device cannot be fully evaluated without implementing an optimization routine with hardware in the loop.

As has been mentioned above, the temporal variations in air acceleration and in pressure derivative $\Delta p$ also correspond to the sound signal generated by the talker, in a manner similar to that of uncancelled sound pressure. Thus, to embody the signal that signifies the spoken sounds to be communicated, variation over time in $\Delta p$ can be transduced into an electronic signal and transmitted. Thus, as shown in FIG. 5, $V_{out}$ can be taken at 559 directly from the output of the comparator 558, or, it can be derived from the filtered signal $K(z)\Delta p=V_L$ at 557, whichever is more convenient.

Hardware

Figure 6:
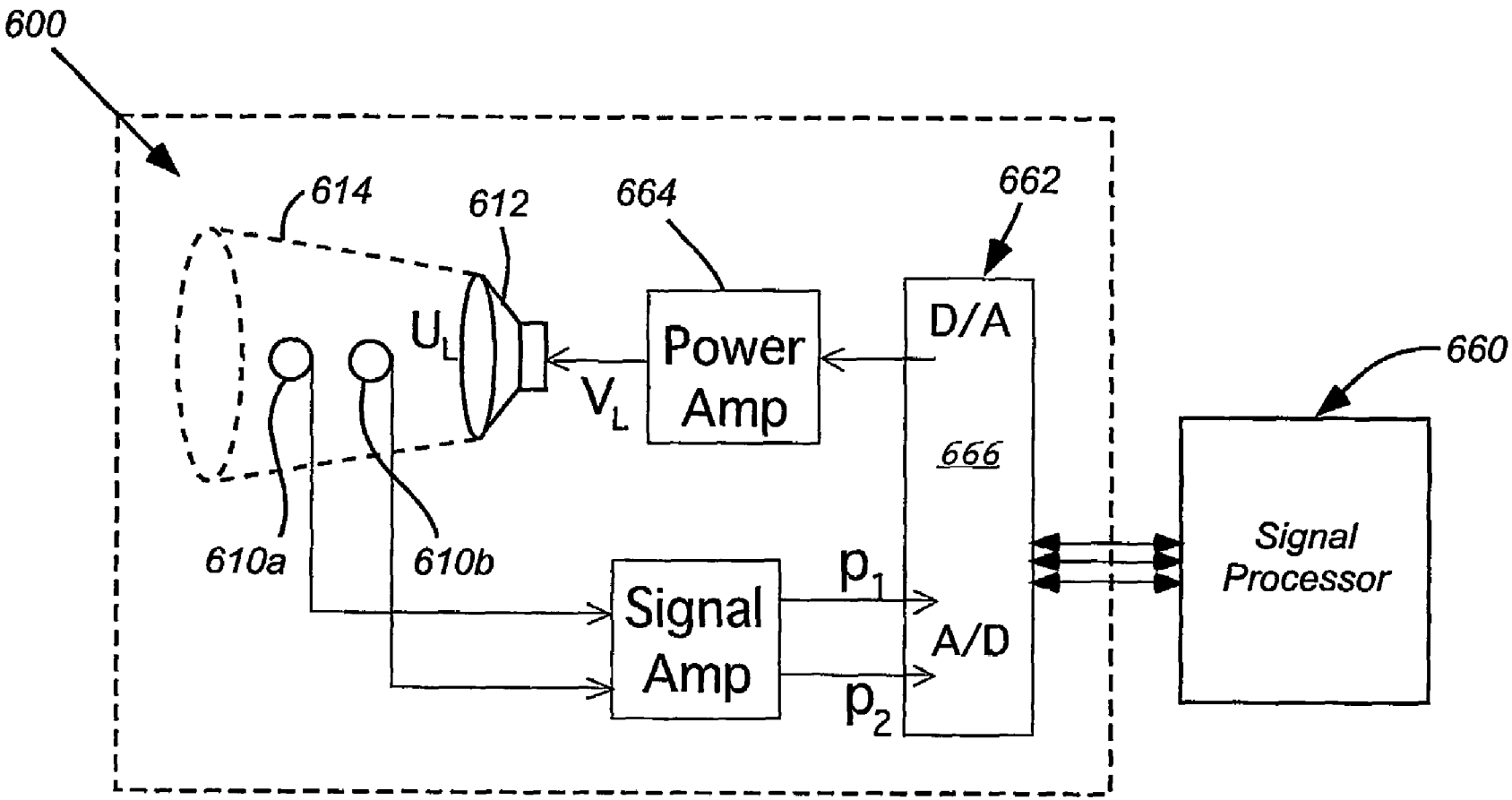
FIG. 6 is a schematic representation of hardware components of a transducer of an invention hereof.

FIG. 6 shows a basic implementation 600 of a system. The frequency range is limited to that required for understandable speech, from about 200 Hz to 3000 Hz. Electronic signal processing in a prototype is done using a digital signal processor (DSP) 660 with an A/D and D/A 662 card. This prototype can be used to confirm a signal processing method and acoustical performance.

This implementation is designed to be used without a shroud 614 and/or windscreen if possible, but there will likely be applications where a shroud is necessary and acceptable. If a shroud is needed, one as small as possible is desirable. The microphones 610*a* and 610*b* should preferably be as small, as close together, and as close to the loudspeaker 612 as possible, consistent with the need for a measurable phase difference in microphone outputs. To deal with the inevitable phase mismatch between moderately priced microphones, it is desirable at times during prototype setup to reverse their locations using a swiveling holder for the prototype. This technique allows for phase calibration.

In this implementation, the microphone signals $p_1$, $p_2$ are sampled using an A/D board in a dedicated Digital Signal Processor (DSP) 660. For instance, a DSP board, such as available from Analog Devices of Norwood, Mass. under model AD73522, is adequate. The signal $V_L$ input to the loudspeaker is continuously adaptively updated and generated in the DSP computer 660 as discussed above, and fed to a power amplifier 664 using a D/A channel 666 on the same board 662. The processing and board control software will be appropriate for the board of choice.

The microphones and loudspeaker should be as small as possible while still providing otherwise acceptable performance. It is intended by the inventors hereof that any suitable pressure sensing or sound producing devices now in existence or developed in the future may be incorporated into a device embodying features of the claimed inventions. For instance, a technology that is just emerging as of the filing of the application hereof (2004) is an integral sound chip, that can include electronics for signal processing, and silicon membrane microphones and speakers, as described in Stix, G., *Micro (mechanical)phones*, Scientific American, p. 28 February 2004, which is incorporated herein fully by references. Basically, vibrating membranes up to about 1 mm sq. are fabricated into a semiconductor device. The membranes can be made to vibrate in response to an electronic signal, thereby constituting a loudspeaker. They also vibrate in response to an acoustic disturbance, and generate an electrical signal corresponding thereto, thus, constituting a microphone. Different sizes of membranes are sensitive to or generate sound of different frequency ranges, depending whether a microphone or a loudspeaker. They can be made to be very small, and very close together. Many such microphones could be placed in an array of virtually any geometrical design. A single device can include many membranes, each responsive to a different distinct or overlapping frequency range. It is expected that they will be made by CMOS (complementary metal oxide semiconductor) processes.

Directional Aspects

Two different directional aspects are important in understanding inventions hereof. The first relates to privacy of a talker, and sound radiated away from the talker. The second relates to quality of sound transduced, and immunity of the transmitted signal from acoustic background noise.

Privacy and Radiated Sound

An acoustical model of a talker using a transducer as generally described above treats the system (talker+loudspeaker) as a pair of acoustical monopoles of opposite sign, since the loudspeaker 212, a monopole, will draw in volume velocity fluctuations equal to that produced by the lips 202 and nose 203 of the talker 206, together, the second monopole. This increases the magnitude of the acceleration of the airflow and reduces the pressure at the microphone array and in the far field, as compared to the effect of the talker alone.

For purposes of initial discussion a two microphone arrangement of FIG. 2 will be discussed, but similar and potentially better results are achievable with an array of more than two microphones, which is discussed further below.

A talker speaking alone, a monopole, radiates sound more or less uniformly outward in all directions. It has little directionality. More precisely, the human voice is nearly omnidirectional at 200 Hz, where the wavelength is about 1.7 m, but it is directional (but not unidirectional) at 3 kHz, where the wavelength is 0.12 m.) Thus, its directionality is generally independent of any angular relation $\theta$ between a monopole and an observer. With a dipole, if the distance between the talker's lips and the loudspeaker is less than ⅙ of a wavelength, about 2 cm at 3,000 Hz, the upper range of frequency for speech, the incompressible terms in the flow field dominate. In this situation, the radiated sound pressure has the dipole directionality of $|\cos\theta|$, which reduces the radiation to the surrounding area as compared to a monopole.

Figure 8:
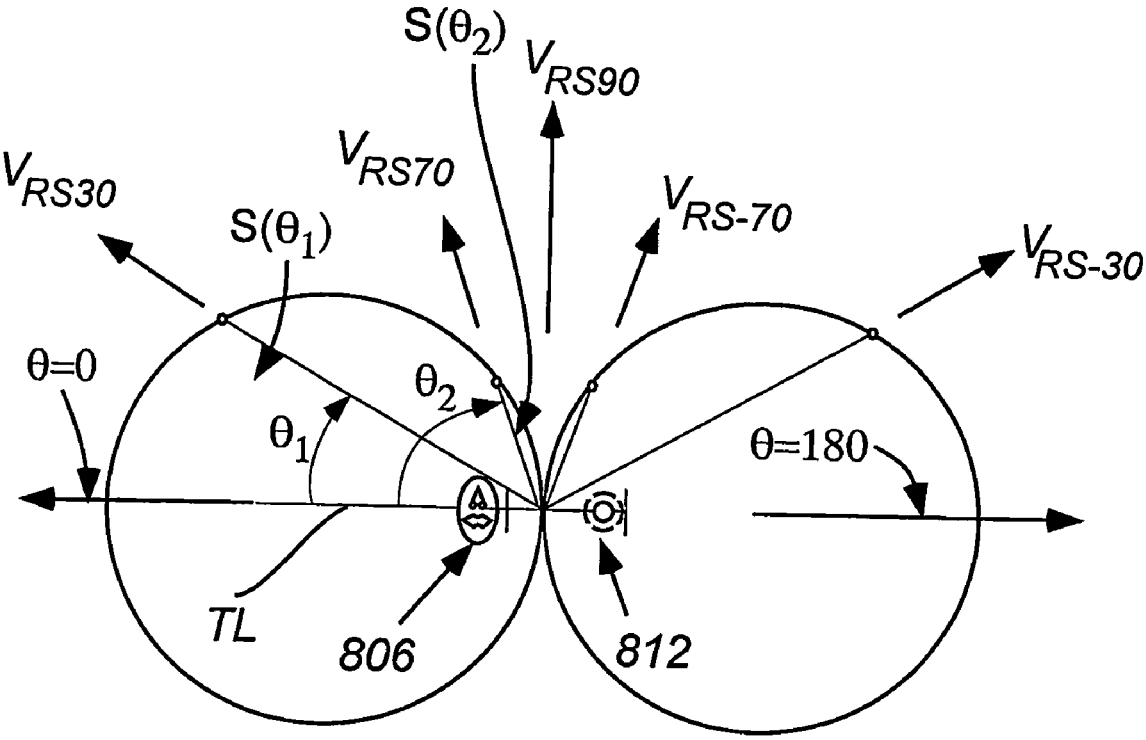
FIG. 8 is a schematic representation showing directional radiation of a dipole generator, of a talker and a loudspeaker.

A directionality plot of the type familiar to acousticians, showing a dipole radiation directionality of $|\cos\theta|$, is shown schematically in FIG. 8. The talker 806 and the loudspeaker 812 constitute the monopoles of the dipole. The directional radiation plot shown in FIG. 8 depicts the intensity of sound pressure radiated toward different directions from a dipole generator. Basically, the intensity of sound in any direction $\theta_i$ is proportional to the length of a line segment $S(\theta_i)$ from the midpoint between the two monopoles 806, 812, to its intersection with one of the two circles. Thus, the intensity of sound pressure radiation along directions represented by vectors $V_{RS30}$ and $V_{RS-30}$ is equal, to each other and greater than that of sound pressure radiated along directions represented by vectors $V_{RS70}$ $V_{RS-70}$. The intensity of sound pressure radiated along a direction $V_{RS90}$ perpendicular to the line TL that joins the talker 806 and the loudspeaker 812 is essentially zero. Thus, there are some directions toward which the intensity of radiated sound is much less than for other directions.

Therefore, in general, a dipole generator behaves quite differently from a monopole generator, which has no directionality.

Figure 13:
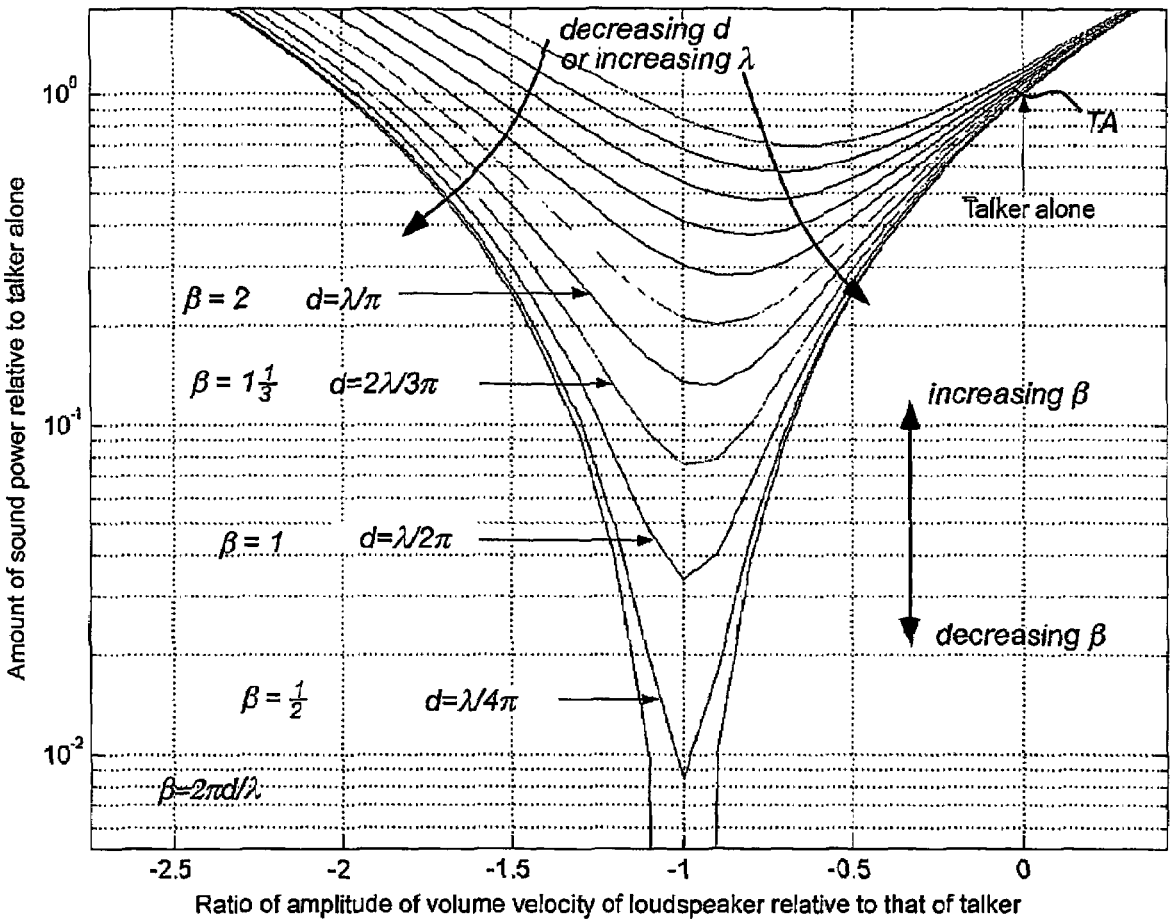
FIG. 13 is a schematic graphical representation showing the ratios of: on the vertical axis log scale, amount of sound power radiated away from the combination of loudspeaker and talker; to a talker alone, and, on the horizontal axis, amplitude of volume velocity of loudspeaker relative to that of a talker alone for different combinations of spectral frequencies and separation from talker to loudspeaker.

FIG. 8 depicts relative intensity of sound pressure in different directions, but it says nothing about the absolute intensity, in any direction, particularly as compared to a talker alone (a monopole). In general, that topic is discussed below, in connection with FIGS. 13 and 14. FIG. 8 assumes a baseline ratio of radiated sound, as compared to a talker alone, and then depicts the degree of radiated sound in different directions. FIG. 13 compares the ratio of radiated sound of a dipole to that of a talker alone, for different combinations of frequency, separation between talker and loudspeaker, and amplitude of loudspeaker relative to the talker, all of which is discussed below. (FIG. 13 assumes the loudspeaker is exactly out of phase with the talker.) In general, that discussion shows that for certain combinations of these parameters, the amount of sound power radiated for the dipole is much less than for the talker alone. This situation improves privacy, as compared to a talker speaking alone (mono pole) for two reasons: 1) the dipole can be designed to radiate less sound power in its directions of maximum sound power than a talker alone; and 2) the dipole radiates less sound power in certain directions than in its directions of maximum sound power.

Sensitivity to Acoustic Background Noise

As mentioned above, another aspect of the disclosed inventions that requires consideration of directionality, is sensitivity to acoustic background noise. In general, a transducer having a single microphone is equally sensitive to acoustic background noise coming from all directions. This noise will add with the sound coming from the talker and will be transduced equally. One embodiment of an invention hereof is equally sensitive to sound coming from all directions. Other, typically more useful embodiments, can be designed so that they are more sensitive to sound coming from the talker.

In general, the directional sensitivity to background noise is attributable to weightings of the microphone signals as they are combined in $p_t$. As has been mentioned above, with a two microphone embodiment, the microphone signals $p_1$ and $p_2$ are summed in a summer 550, which sum $|p_t|$ is then compared to a threshold $\epsilon$. In an apparatus as shown in FIG. 5, which conducts a procedure as discussed above, if sound pressure from a certain direction is not sensed in $p_t$ then the system ignores such sound and the loudspeaker is not driven to match it, as it is driven to match the talker. As a result, no portion of the estimated derivative signal $\Delta p$ is generated with respect to such ignored sound. As is discussed above the signal that is transmitted as the output can be either $\Delta p$ itself as at 559, or the electrical input to the loudspeaker, $V_L$, as at 557, which is proportional to $\Delta p$ through the relationship $V_L = K(z)\,\Delta p$. In other words, stating the phenomena somewhat in reverse, the system will drive the loudspeaker to try to produce sound that it senses. If the microphones are arrayed and their outputs are weighted such that they discriminate in favor of sound coming from the direction of the talker, then the system will try to drive the loudspeaker to counter that sound, which will contribute to the value of $\Delta p$. But, sound coming from non-favored directions is essentially not sensed and the system will not try to drive the loudspeaker to counter that non-sensed sound. Thus, the directional sensitivity of $p_t$ also influences $\Delta p$, which is the basis for the signal to be transmitted.

With that in mind, a first case is considered where the microphones have the weightings as set forth below in Table I.

TABLE I

| Two Microphone Weightings | | |
|---|---|---|
| | $p_1$ | $p_2$ |
| $p_t$ | 1/2 | 1/2 |
| $\Delta p$ | −1/2 | +1/2 |

Figure 9:
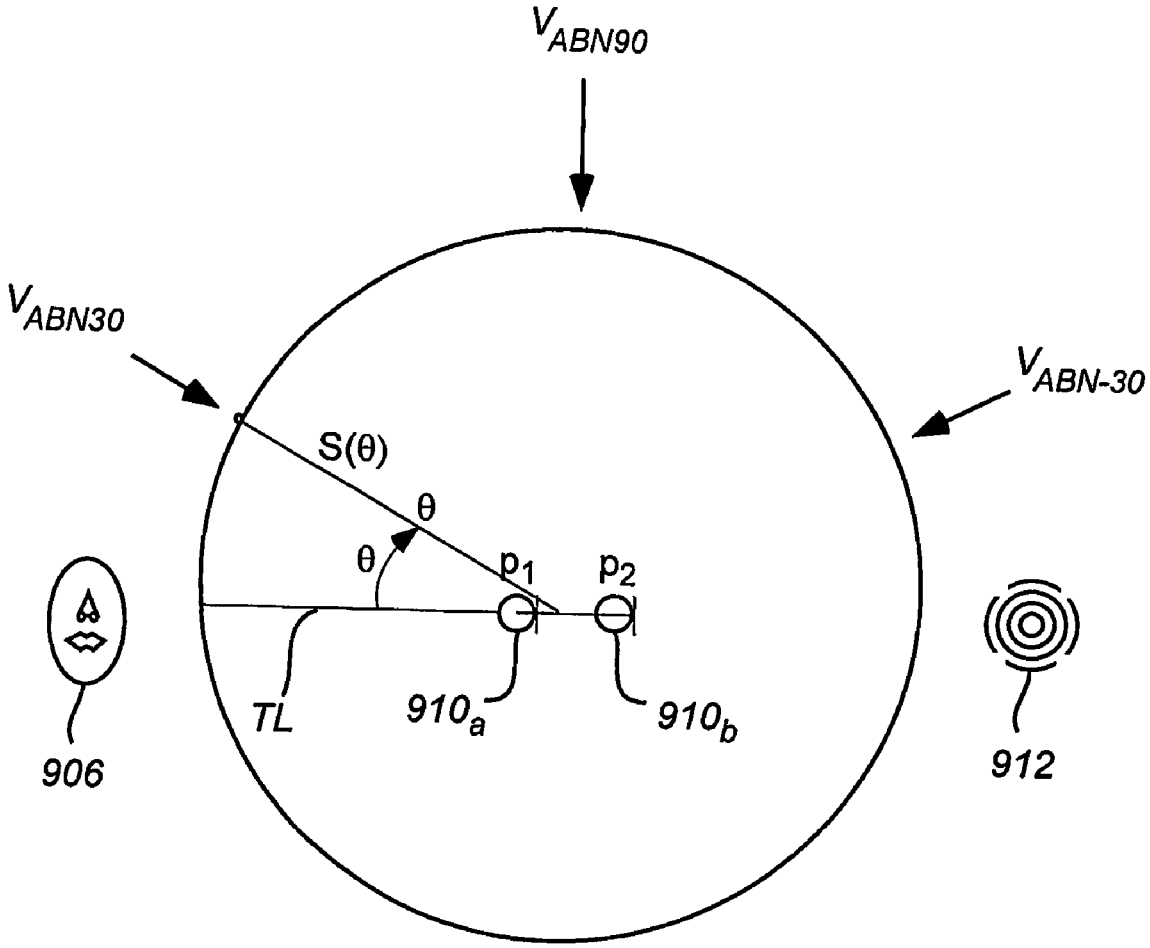
FIG. 9 is a graphical representation of a directional sensitivity (directivity) plot of an omni-directional microphone pair transducer that transduces pressure derivative and uses an equal microphone weighting for $P_t$.

With microphone weightings as shown in the row $p_t$, the system will have no directional sensitivity, as shown in FIG. 9. It will be equally sensitive to sound coming from all directions, which is identical to a single microphone apparatus. The microphone weightings in the row $\Delta p$ effectively extract the estimate of pressure derivative from the pressure measured by the microphones. Although there might be a very small effect on directional sensitivity due to the microphone weightings used for $\Delta p$, the effect is so small that it can be ignored. In embodiments discussed below, a much more significant effect can be achieved by adjusting the microphone weightings that are used to determine $p_t$.

Figure 10:
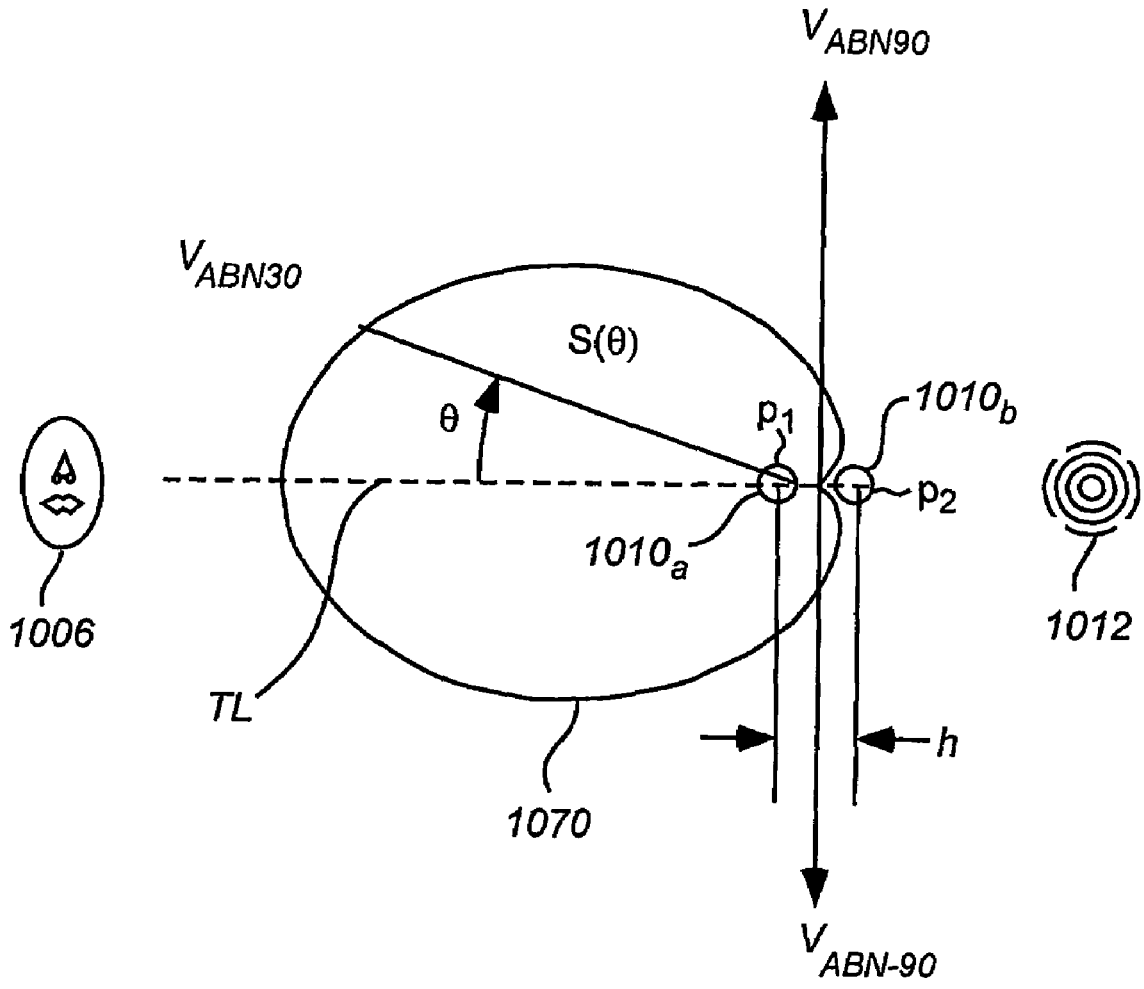
FIG. 10 is a graphical representation of a cardioid directional sensitivity plot of a microphone pair transducer that transduces pressure derivative and uses unequal, specifically tailored microphone weightings.

FIG. 10 shows schematically the directional sensitivity for a sensor based on pressure waves incident from various directions for what is known as a cardioid weighting of microphone outputs. Such a directivity discriminates strongly against ambient noise from a direction from the loudspeaker 1012, and is less sensitive to sound from directions other than directly from the talker 1006. The shape of the direction sensitivity curve 1070 approximates a cardioid. Such a cardioid sensitivity can be achieved with a microphone weighting as set forth in row $p_t$ in Table II, below.

TABLE II

| Cardioid Microphone Weighting | | |
|---|---|---|
| | $p_1$ | $p_2$ |
| $p_t$ | 1 | −(1)/x |
| $\Delta p$ | −1/2 | +1/2 |

In Table II, $$x = e^{\frac{-i\omega h}{c}},$$

where $\omega$ is the frequency of sound in question, h is the spacing between microphones, as shown, and c is the speed of sound in the medium. (Thus, the weighting can be established by a filter that has a frequency dependent gain.) (For example, the filter could be part of the summer 550. The function x is essentially a time delay and may be incorporated after the signals have been sampled and digitized.) This will require a sampling rate of the pressure sensors on the order of at least 6 times the highest frequency of interest to achieve the needed time shift by shifting the data by a single sample.

The sensitivity in any particular direction $\theta$ is proportional to the length of a line segment $s(\theta)$ along that direction from the midpoint of the array, to where that line intersects the curve 1070 shown. Generally toward the talker 1006, where the curve 1070 is roughly elliptical, the sensitivity is rather large. However, away from the talker, the curve has an indentation and is otherwise very near to the origin. Thus, the array is not at all sensitive to sound from the direction of the loudspeaker. The cardioid array is slightly sensitive to sound from a direction that is perpendicular to the line TL, as indicated by the vectors $V_{ABN90}$ and $V_{ABN-90}$, which just graze the lobes of the curve 1070 and intersect the curves after only a very short distance. Thus the system will operate to reduce the pressure due to the talker and be much less sensitive to ambient sounds arriving from most other directions. However, it is still undesireable that there is some small sensitivity to sounds arriving from a direction perpendicular to the line TL such as along line $V_{ABN90}$.

The sensitivity is also symmetric with respect to sounds produced above and below the line TL, as shown in FIG. 10. However, that symmetric sensitivity is not undesireable.

Figure 11:
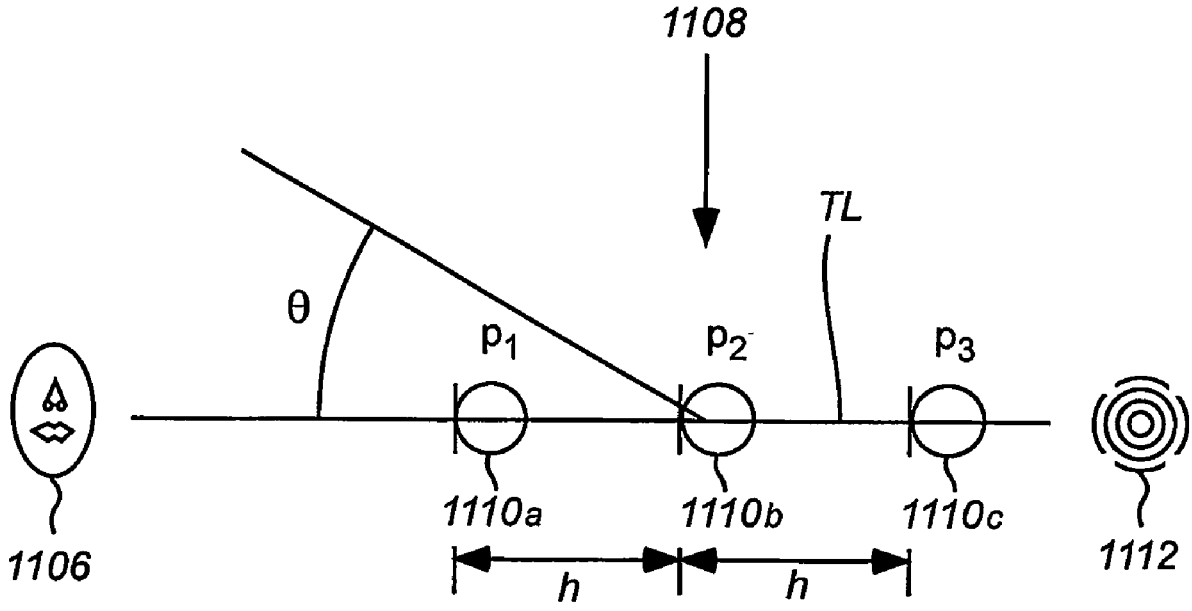
FIG. 11 is a schematic representation showing relative locations of three microphones in an array of an invention hereof.

The undesired sensitivity of the cardioid can be further reduced by using an array 1108, as shown in FIG. 11, of three microphones 1110*a*, 1110*b* and 1110*c*, which produce signals representative of pressure designated $p_1$, $p_2$ and $p_3$ respectively. When the sensitivities of the microphones are adjusted according tρ known principles of microphone arrays, such as in the row $p_t$ in following Table III, where x is as above, the directional sensitivity of this array 1108 becomes that shown in FIG. 12, which is referred to herein as a superdirective sensitivity, as that term is generally understood to acousticians. In general, the array 1208 shows significant sensitivity in directions between θ=0° to about θ=±45°, generally toward the talker 1106, and virtually no sensitivity anywhere else, except along the small lobes 1272 and 1274.

TABLE III

| | Three Microphone Weighting | | |
|---|---|---|---|
| | $p_1$ | $p_2$ | $p_3$ |
| $p_t$ | 1 | −(x + 1)/x | 1/x |
| Δp | −1/2 | +2 | −3/2 |

Figure 12:
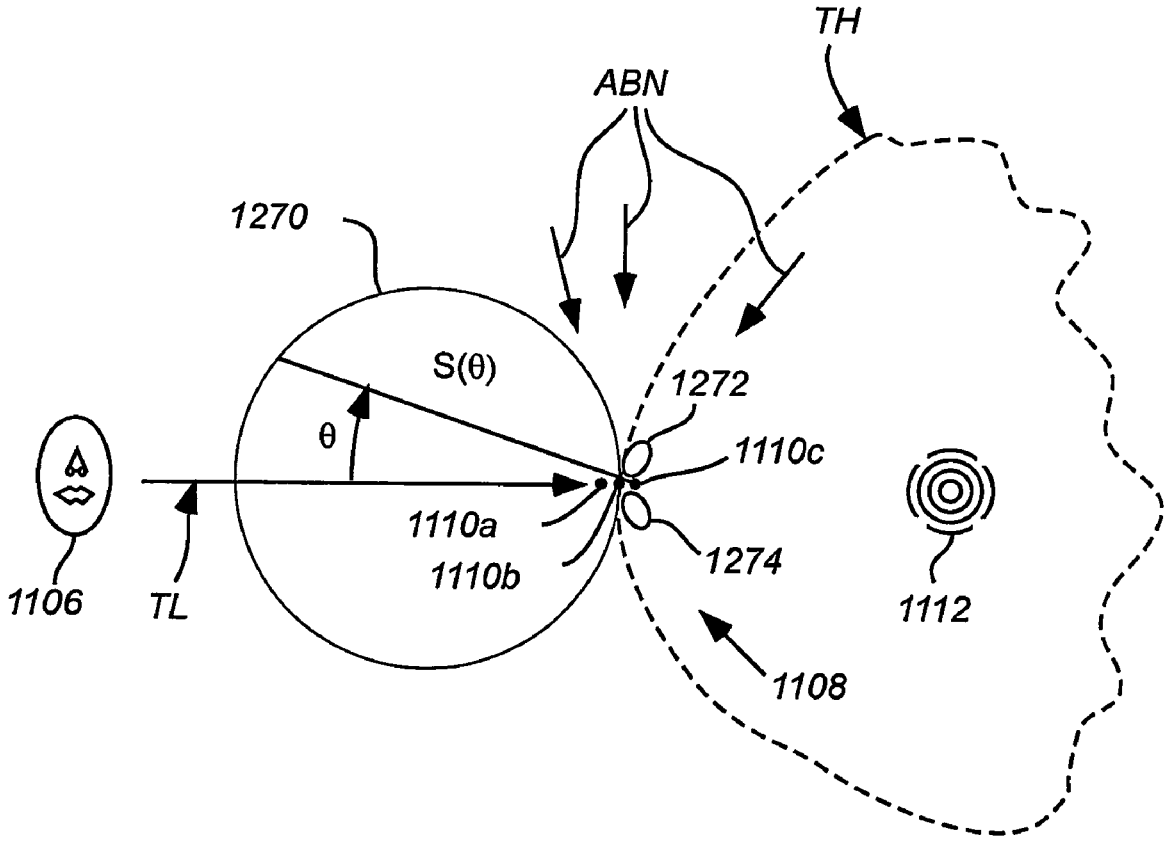
FIG. 12 is a schematic representation showing a directional sensitivity plot for a three microphone array as shown in FIG. 11, when weighted for $p_t$ as described in the specification, which is highly sensitive toward one direction where a talker may be located, and insensitive toward other directions.

In general, and as used in the claims hereof, any microphone weighting that establishes a directional sensitivity toward the talker that is at least 10 dB more than the sensitivity in any direction that is between +90 through 180 to −90 degrees is considered to have a directivity sensitivity that is substantially similar to the superdirectivity sensitivity shown in FIG. 12.

It is thus, an aspect of the invention, to use a property that is significantly reduced, or even minimized, that is, $p_t$, to establish an important performance characteristic of the transducer, namely directional sensitivity.

The foregoing discussion of directional sensitivity has provided microphone weightings for use determining $p_t$. It has also provided microphone weightings for determining Δp. If the Δp weightings shown are used for either the two or three microphone situations, then the system will provide an acceptably accurate estimate of the derivative of pressure, which as has been noted is proportional to acceleration. It is thus reasonable to use the same weightings for both the non-directional (Table I) and the cardioid (Table II) cases and the slightly more complicated weightings shown in Table III, for three microphones. The weightings for the estimate of derivative, though, have only minimal effect, if any, on the directional sensitivity of the array. (It is known from finite difference analysis that using the weightings for three microphones gives a slightly better estimate of the pressure derivative (and acceleration) from the spatially separated measurements of pressure).

These basic estimates, which assume free field acoustics, can be refined with more detailed calculations for actual geometries. Other geometries, such as the addition of a shroud as shown in FIG. 2, can be analyzed and optimized regarding directivity and frequency response using well known computational algorithms, such as finite element analysis and boundary element methods. The calculations can quantify the expected benefits, both in terms of insensitivity to ambient sounds and privacy. Independent of algorithms, a realistic model should be used for the acoustics of this acceleration based transducer system.

Modeling

The acoustical inputs to the transducer 208 (FIG. 2) are the volume velocity fluctuations from the talker's lips and nose, $U_T$, and the volume velocity fluctuations from the loudspeaker, $U_L$. The volume velocity fluctuation, $U_L$ is determined by the voltage $V_L$ applied to the loudspeaker. For the purpose of this discussion, the pressure difference using an array of only two microphones 210*a* and 210*b* is actually an estimate of the spatial derivative along the line joining the two microphones that is estimated, as shown in FIG. 2. The pressures $p_1$ and $p_2$are sensed by microphones 210*a* and 210*b*, respectively, at those locations, which then output electrical signals proportional to $p_1$ and $p_2$. A purpose of this model is to determine the functional relationships among these variables for design optimization. Such a model can provide a good indication for the directions that system parameters should be changed for improved behavior.

As noted above, an important use for a model is dealing with the geometry of the space between the talker 206 and the loudspeaker 212. If a shroud 214 is present, as indicated in FIGS. 3A and 3B, then the acoustics are different than if there is no shroud. The acoustical model has to accommodate that option. If the spacing h between the two microphones is less than ⅙ the smallest wavelength, as discussed above, then compression in the air between them can be neglected and the acoustic element that produces $H_{12}$ in FIG. 4 can be considered a simple acoustical mass, the value of which will depend on the shroud geometry. The spaces between the talker 206 and the microphone array and between the loudspeaker 212 and the microphone array are more complicated and the analysis will benefit from the assistance of a computational model for refinement in the design.

Computational analysis can be used to quantify the elements shown. The boundary element acoustical model (BEMAP), and finite element algorithm (ALGOR) are example programs that can be used to represent the acoustics of this space. The principal use of the model is to determine the effects of variations that are inherent in any physically constructed system on the performance of the system as a whole. For example, it is desirable to keep the spacing h between the microphones in the array 208, for instance the two microphones 210*a* and 210*b*, as small as possible, so that the handheld unit is small enough to be housed within a conventional cell-phone or other handheld housing. It is possible to minimize this distance if phase-matched microphones are used, but such microphones can be expensive. If cost is important, other approaches may be exploited. The acoustical analysis should be carried out in conjunction with computational choices and experimental evaluations.

Enhancing Acceleration and Reducing Pressure—Two Microphone Example

The following addresses how enhancing air acceleration and reducing pressure is accomplished. First, a two microphone example is used. This is a linear system. Therefore, all of the variables are proportionally related. But Δp is a strong signal. Therefore it can be used, with the filter K(z), to minimize the talker pressure sum $p_t$. With the proper amplitude and phase of K(z), one can produce a $V_L$ that will minimize $p_t$. Minimizing $p_t$ has the additional benefit of reducing radiated sound because $p_t$ is minimized when $U_L=-U_T$. This occurs because the volume velocity fluctuations produced by the loudspeaker draws in the volume velocity fluctuations produced by the talker, and prevents compression of air by the talker's volume velocity fluctuations (and, also, simultaneously, the loudspeaker velocity fluctuations).

Referring to FIG. 5, the microphones 210*a* and 210*b* will measure the pressures $p_1$ and $p_2$ at their locations. The acceleration is proportional to the spatial derivative of sound pressure at any given time. An acceptable estimate of the derivative is the sound pressure difference between those locations in space at the same time. Thus, using the signal Δp, the required voltage $V_L$ to the loudspeaker is given by $$V_L=K(z)(\Delta P), \quad \text{(Eq. 2)}$$

where K(z) is a function of frequency (z) that is chosen to reduce pressure attributable to the talker $P_t$ which represents a weighted sum of outputs from the microphones, in the frequency domain.

The exact form of K(z) to achieve the greatest reduction in pressure depends on the loudspeaker and on the geometry of the transducer (the spacing between microphones and the arrangement of microphones in the array, and the spacing between microphone(s) and the loudspeaker). It may also depend on the geometry of the talker's face and other items that will vary from one situation to another. The acoustical model shown in FIG. 4 has the generality to account for this acoustical variability.

Keeping in mind that variation in the estimate of the derivative ΔP contains all of the information contained in variation in sound pressure, once K(z) is determined, the loudspeaker voltage $V_L$ may be used from which to derive for instance, a telephone signal to a distant listener:

$$\Delta P=K^{-1}V_L. \quad \text{(Eq. 3)}$$

where ΔP is the estimate of the derivative of pressure in the frequency domain and $K^{-1}$ is a matrix inversion. It is most likely that the best signal to use will be $K^{-1}V_L$ but it is also likely that sending $V_L$ directly would be acceptable.

Alternately, the two microphone signals themselves may be used to create Δp and used to generate the signal to be transmitted from the transducer device to a distant listener.

A major purpose of the microphones 210*a* and 210*b* is to measure an estimate of pressure derivative in the region between the talker 206 and the loudspeaker 212. The estimate of derivative is along the line that passes through both microphones and the loudspeaker. Since there must be a finite distance between the microphones of the array, e.g., 210*a* and 210*b*, estimating the derivative can be improved by increasing the number of microphones in a way that is well known from finite difference analysis. Estimating the pressure derivative from microphone measurements is a special aspect of the present inventions. A pair of microphones is adequate for an estimate, but a larger number may be used to improve the estimate. For example, the three microphone array shown in FIG. 11, weighted as discussed above, can make a more accurate estimate of the pressure derivative than can a two microphone array.

A two-microphone arrangement is used here to demonstrate the principles. (A three microphone array, weighted as above, would follow the same principles. The acceleration of the air in the space between the two microphones, a(t), is governed by the difference in the sound pressures, $$\partial p/\partial x=-\rho a(t), \quad \text{(Eq. 4)}$$

or $$a(t)\approx(p_1-p_2)/\rho\Delta x, \quad \text{(Eq. 5)}$$

where x is a unit length along a line that joins the two microphones and loudspeaker. (Eq. 5 is the same as Eq. 1b, repeated here for convenience.)

A processing routine of the type discussed above in connection with FIG. 5 is used to reduce significantly the pressure sum, $P_t$, while increasing significantly the pressure derivative, ΔP. To achieve this in the frequency domain, the voltage $V_L$ applied to the loudspeaker should be proportional to that pressure difference, e.g., as set forth in Eq. 2, which is repeated here as Eq. 6:

$$V_L=K(z)(\Delta P). \quad \text{(Eq. 6)}$$

The magnitude and phase functions of K(z) are chosen to significantly reduce the sum of complex amplitudes $P_t$, as indicated at 540 and 552. The enhanced acceleration, or the estimate of the pressure derivative Δp, which is the signal output of the acceleration based transducer desired to be transmitted, is then readily calculated from the voltage $V_L$ using Eqs. 2 and 3 in combination.

When turbulence is present, the relationship between the pressure derivative and the acceleration expressed in Eq. 4 is altered to become (for one dimensional inviscid flow), $$\partial p/\partial x=-\rho a(t)-\partial(\rho u^2/2)/\partial x, \quad \text{(Eq. 7)}$$

where $u=\int a\,dt$, is the velocity of the airflow at the array and x is the unit length along the direction of flow. The new term involving velocity u is the convective acceleration and its presence means that the relation between pressure and acceleration is altered from that shown above in Eq 1. In turbulence, the two terms on the right-hand side may be comparable in magnitude. However, since an invention hereof measures pressure derivative it may be possible to derive a velocity estimate from the measured pressure difference and correct for some of the turbulence effect. The consequences of this are not certain, but it may be that a transducer of the present invention will always benefit from some sort of windscreen for protection, if airflow noise is a problem.

While the operation of an acceleration based transducer has some features similar to an active noise canceller, in significantly reducing the total pressure, unlike an active noise canceller, an acceleration based transducer also significantly enhances the pressure derivative estimated by Δp. If, sound arriving at the array does not come from the direction of the talker (namely ambient noise), the pressure from those sounds does not contribute to the talker pressure sum $p_t$ to be minimized. Reducing the talker pressure output from the microphone array will not increase Δp due to such ambient noise, leading to less pressure spatial derivative output from the microphone array and the desired immunity from ambient sound.

There is an advantage to having both the loudspeaker input voltage $V_L$ and the direct microphone array output Δp signals available to transmit. This helps to understand an important aspect of using pressure derivative of the signal to be transmitted. If there is a loudspeaker failure, the microphone outputs will remain. The privacy feature (reduction in radiated sound) and enhancement of Δp will be lost, but the device will still work as a telephone. That would not be the case for a single microphone system that would simply monitor and reduce the pressure and use a loudspeaker signal as a transmitted signal. In that case, if the loudspeaker were to fail, the transmitted signal would be lost. (The microphone signal cannot be used in such a system because its output would have been significantly reduced, essentially minimized.)

The following discussion explores relationships that may be exploited to help design adaptive filters, discussed above, to change ΔK based on the total pressure, etc.

Effect of Strength of Loudspeaker and Separation on Radiated Sound

FIG. 13 is a graphical representation that shows, schematically, on the vertical, log scale, the ratio of sound power radiated away relative to that which would be radiated by a talker alone. The horizontal scale, (which is not a log scale), shows the ratio of the amplitude of volume velocity of the loudspeaker relative to that of the talker alone. Both scales plot a dimensionless ratio of a value, as compared to some aspect of the situation for the talker alone. Thus, one can see the effect on radiated power of varying the amplitude of the volume velocity of the loudspeaker. The parameter β is proportional to a ratio of the separation d between the talker 206 and the loudspeaker 212, compared to wavelength λ of the spoken sound.

In general, $$\beta=2\pi d/\lambda. \quad \text{(Eq. 10)}$$

β is essentially a frequency parameter. For constant d, β decreases as the frequency decreases (and the wavelength increases). For constant λ, β decreases as the separation d decreases. FIG. 13 shows, various curves, for different d/λ. Four curves are pointed out, for which the separation d between the talker and the loudspeaker is λ/2π times 2, 1⅓, 1 and ½, respectively, which corresponds to β equal to 2, 1⅓, 1 and ½, respectively. The curve for the smallest d/λ is lowermost, meaning they result in generally less sound power being radiated away as compared to the talker alone, than is the case for larger d/λ, as represented by the upper curves.

For any given separation d, and wavelength of speech λ the lowest amount of radiated sound relative to that of the talker alone is represented by the minimum of an individual curve. For instance, for d=2λ/3π, the minimum occurs near to where the amplitude of the volume velocity of the loudspeaker relative to the talker equals minus 1 (perfectly out of phase), as shown on the horizontal scale. If the loudspeaker is in phase with the talker (to the right of 0 on the horizontal scale), then the sound power radiated away is greater than that of the talker alone (greater than 10°=1 on the vertical scale). (FIG. 13 is intended to illustrate an optimal case where the loudspeaker is exactly out of phase with the talker. However, there might be a slight improvement by phase adjustment away from the minima in the curves.)

If the amplitude of the loudspeaker is less than about negative two times that of the talker alone, then there is no combination of separation d and wavelength λ that would result in radiated sound being less than that of the talker alone (because to the left of −2 on the horizontal scale, all curves exceed 10° on the vertical scale). Note also, that for this example, the curves are more symmetric about the minima for smaller β (or d/λ). For larger β, the minima are skewed more toward loudspeaker strength being between about −1 and about −0.5.

For smaller β, the trough sides are steeper and the breadth of the trough is narrower. Namely, there will be a more significant reduction in sound power radiated, for a change in the amplitude of the loudspeaker, toward negative 1 times that of the talker alone (from either greater or less than −1). Also, the minima become broader as β increases, which means that the maximum effect on reducing radiated sound for any β (minimum radiated sound) will take place over a broader range of mismatch between the strength of the loudspeaker and strength of the talker alone, although the reduction in radiated sound from that of the talker alone will be less. Thus, for larger β, the system will tolerate more error in the attempt to drive the loudspeaker to exactly draw in the volume velocity produced by the talker. Thus, if a relatively smaller degree of reduction in radiated sound is acceptable, it will be easier to achieve that reduction.

For example, at 3 kHz, the wavelength λ of sound is about 12 cm (4¾ in), so that d/λ (=1/π) corresponds to a distance d between the talker and the loudspeaker of about 3.8 cm (1.5 in). The curve shows that for this separation, and with the loudspeaker exactly out of phase from and with the same amplitude as the talker, at 3 kHz, the radiated sound from such as system is 12 dB less than that of the talker alone (corresponding to only 0.08 times that of the talker for a reduction of 92%). At 2 kHz, with d=5.23 cm, the radiated sound is 8 dB less than that of the talker alone (corresponding to 0.158 times that of the talker for a reduction of 84%).

FIG. 13 can also be used to understand the performance of a particular embodiment, as the handset and included loudspeaker are moved toward and away from the talker. The parameter d represents the separation between talker and loudspeaker. Typically, during talking, the talker maintains the handset and thus the microphones and loudspeaker, in a fixed location for periods of time that are relatively long compared to the oscillatory period of any relevant frequency of speech, and thus d is relatively constant. The parameter in question, d/λ, will be unique. The family of curves shown in FIG. 13, therefore, show how different parts of the frequency spectrum of speech are radiated. Longer wavelengths (lower frequencies) correspond to a smaller β and are therefore attenuated more than are higher frequencies. Therefore, whatever sound is radiated to the environment in which the talker speaks, will be a raspier version of the talker's speech. However, to the extent that the talker moves the handset, for instance, closer to the talker's mouth and nose, to analyze the effect, one moves along from curve to curve in the direction of decreasing d, generally downward as shown. Thus, for a given frequency of speech, as the separation decreases, the amount of sound power radiated also decreases.

In general, embodiments of inventions hereof can be characterized as apparati and methods that establish an approximate acoustic dipole generator, with the talker's mouth and nose constituting one pole and the loudspeaker constituting the other. In general, as used herein, an approximate dipole generator or a generator that operates substantially as does a dipole is a generator that results in at least 10 dB reduction in overall radiated sound pressure, as compared to a single source (e.g., a talker) monopole, alone. FIG. 13 depicts essentially an ideal dipole generator.

FIG. 13 can also be used in conjunction with FIG. 8, which shows, in general the directionality of radiating sound power from an acoustic dipole. The directionality remains the same for all such dipoles, represented by two equal size circles. However, comparing two situations, with different β, for a given ratio on the x-axis of volume velocity of loudspeaker relative to a talker alone, one can consider the diameter of corresponding circles changing in accord with the location of vertical axis coordinate for the different β curves shown on FIG. 13.

The locations of the microphones in the array relative to each other have no effect on the graphs shown in FIG. 13. But, separation among the microphones is needed to be able to estimate the pressure derivative, to make the loudspeaker out of phase with the talker, and of the correct strength.

Turning to a generalization regarding the locus in which radiated sound is reduced, it is instructive to consider three spatial regions of importance, characterized in terms of two important characteristic lengths. The two characteristic lengths are d, the distance between the talker and the loudspeaker (which corresponds to the size of a source) and the wavelength $\lambda$ of the sound in question. The three spatial regions r of importance are: 1) $r<\lambda/2\pi$ (inertial field); 2) $\lambda/2\pi<r<d$ (geometric field or Fresnel zone); and $d<r<2d/\lambda$ (far field or Frauenhofer zone). Radiated sound will occur in the geometric and far fields. Since d is very small in this case these two zones then constitute essentially everywhere. In the absence of silencing, the audibility of another person's speech will drop off because of background noise. However, in a quiet environment, the unmitigated sound can be heard over a substantial distance.

The plot in FIG. 13 generally refers to sound radiated into the far field. In general, an embodiment of-the invention will reduce the radiated sound power in the far field. For a cellular telephone user, a reasonable range over which it is desirable to reduce radiated sound power is from about one foot (30.5 cm) from a talker's face to about 10 feet (3 m). The effects of embodiments of the invention are also appreciable at even greater distances. However, typically, except in the quietest of environments, radiated sound from use of devices such as cellular phones is not a problem at distances beyond 10 feet or so. On the other hand, in specific applications, such as specialized equipment for communications devices for use by military, espionage and law enforcement persons, it may be important to be able to speak into a transceiver, and to have the radiated sound of that speech be reduced so that it will not be detectable at even greater distances.

Loudspeaker Effect on Acceleration

Figure 14:
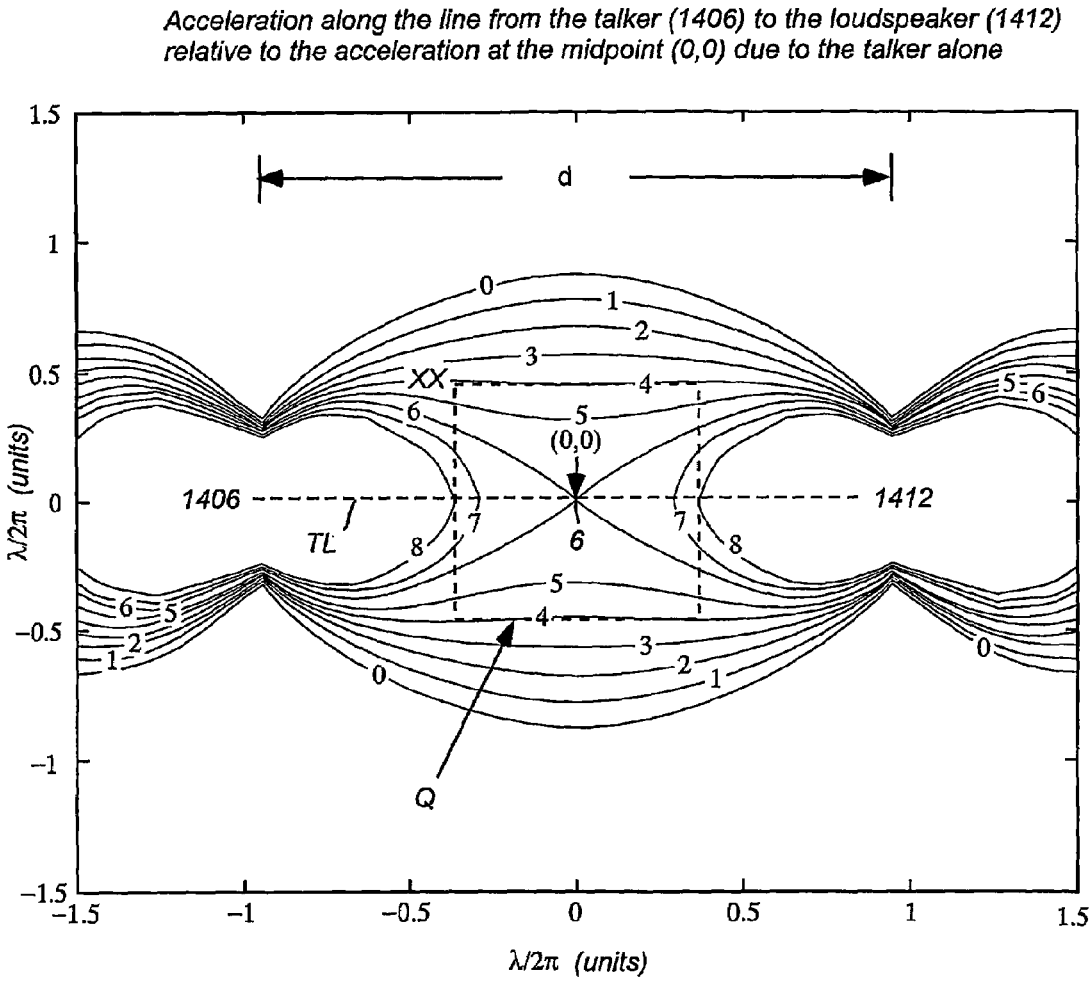
FIG. 14 is a schematic graphical representation showing the fluid acceleration at different locations within an acoustic medium in a region between a talker and a loudspeaker relative to acceleration due to the talker alone at the midpoint of the line TL.

Turning next to transducing speech by measuring acceleration, FIG. 14 is a plot that shows the effect of the loudspeaker on the acceleration of air. FIG. 14 shows the acceleration in a region around the talker 1406 and the loudspeaker 1412, relative to the acceleration due to the talker alone at the midpoint (0,0) along a line TL from the talker 1406 to the loudspeaker 1412. The plot assumes the talker and loudspeaker are perfectly out of phase and of equal amplitude volume velocity. The horizontal scale is location along the direction of the line TL from the talker to the loudspeaker, measured in units of $\lambda/2\pi$. The vertical scale is also location, measured in the same units of $\lambda/2\pi$, away from the line TL. The plot is generated assuming that a microphone pair is placed at a specific location, such as shown schematically at XX (−0.5,0.5), aligned along a line that is parallel to the line TL.

Each curve represents a locus of equal magnitude acceleration of the air due to the talker and the loudspeaker combined, as compared to the talker alone at the midpoint (0,0). For instance, points along the outermost curve, designated with 0, represent the locus of points where the acceleration of air is the same as would be the acceleration of air at the point (0,0), due to the talker alone. At point (0,0), the acceleration (and thus the pressure derivative) is double (6 dB more than) that due to the talker alone at this location.

Acceleration is a vector. The magnitude represented by each contour is the amplitude of the component of acceleration in the direction parallel to the line TL. Each contour is a cross-section through a surface of revolution around the line TL. At the midpoint (0,0) the acceleration with both talker and loudspeaker is twice (6 dB) what it would be at that same location with just the talker alone.

The numerals adjacent the curves represent a comparison between the level of acceleration or pressure derivative that occurs with the talker and the loudspeaker together, as compared to the talker alone at the point (0,0). For example, anywhere along the contour marked 4, the acceleration is 4 dB greater than (about $10^{4/20}$=1.6 times ) what it would be measured at (0,0) if the loudspeaker were not present. If the microphone array is placed directly on the line between the talker and the loudspeaker, at the point (0,0), the increase in acceleration level over what would be produced by the talker alone at (0,0) is about 6 dB, which translates to a signal gain of about two times (the acceleration is doubled). Thus, a microphone array placed along a contour 4, records acceleration 2 dB less than what it would be if optimally placed halfway between the talker and loudspeaker at (0,0). The midpoint (0,0) is considered to be an optimal placement even though the signal gain is not at a maximum because the $\Delta p$ field is much more uniform around this point than it is around regions of higher acceleration, such as along the curves for 7 or 8 dB increase. Thus, the (0,0) position is optimal because it is less sensitive to errors in array placement.

The region within the dashed rectangle Q represents a cylinder within which the acceleration is within ±2 dB of the 6 dB value of the midpoint (0,0). The dashed rectangle exhibits a ratio that is within ±2 dB of the maximum, which, as illustrated, is 6 dB, at the center (i.e., from 4 to 8 dB). The rectangle Q gives an idea of how accurately the microphone pair must be placed relative to the best location so that significant enhancement in sensitivity as a telephone transducer is achieved as compared to a talker alone.

The relative magnitude of acceleration is important because, as has been noted, variations in acceleration can be used as a surrogate for variations in the pressure produced by the talker, which surrogate can be measured, transduced into an electromagnetic signal, and transmitted by the device as the outgoing voice signal. If the acceleration is larger than would exist with the talker alone, then the opportunity exists to use a signal that is large, and can exhibit an improved signal to noise ratio.

Maintaining Talker Privacy and Reducing Bystander Annoyance

As noted, the source of sound for leakage away from a device of an invention herein, is the total volume velocity due to both the talker 206 and the loudspeaker 212. These sources are close in location, but not identical in location, to the microphone array 208 (e.g. a pair) that senses the disturbance from ambient sound. Therefore there is not perfect reciprocity between immunity from ambient sound and reduction of sound radiation away from the transducer 200. This is especially so at higher frequencies above the range of speech, where the wavelengths of sound will be comparable to or smaller than the spacing d between talker and loudspeaker. That can mean that optimization for immunity from ambient noise and optimization for privacy (reduction in radiated sound) may not be equally effective over the entire frequency range of interest. Ambient noise is likely to have much more high frequency content than the speech signal from the talker. The reduction in ambient sound will not be as great as the reduction in radiated speech sound and the improvement in privacy. However, this high frequency ambient noise can be filtered out from the signal to be transmitted (in the amplifier 556 for example) without affecting the voice transmission.

Since the longer wavelength (lower frequency) sounds between 200 and 3000 Hz are of concern for privacy immunity and the concern for ambient noise may concentrate on slightly higher frequencies (1500-5000 Hz), a choice of processing routine to deal with both is possible. Tests using a physically relatively large implementation showed a significant reduction in leakage sound radiated and a simultaneous increase in desired signal from the microphone pair.

Other Considerations

If the loudspeaker is absorbing the volume flow generated by the talker and the local pressure is reduced, one might question whether the talker will be able to hear his/her own voice. In fact, the talker can hear his/her own voice even if the radiated sound is eliminated, because much of what a talker hears as the talker's own speech is due to tissue and bone conduction within the talker's head, and not due only to the sound traveling through the air to the talker's ears.

Figure 7:
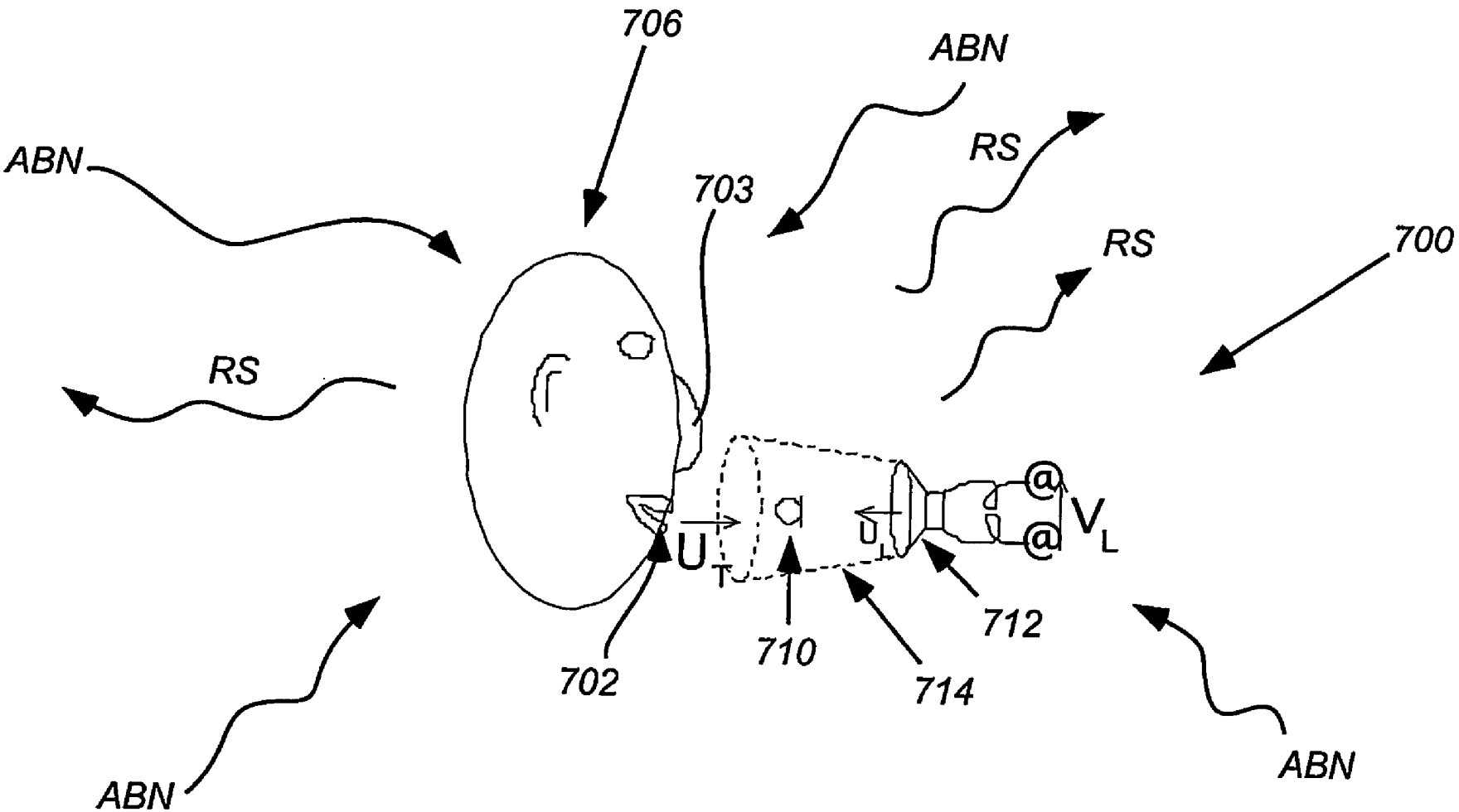
FIG. 7 is a schematic representation showing an embodiment of an invention having only a loudspeaker and a single microphone.

A related invention uses only one microphone, rather than two or more, as shown in FIG. 7. The apparatus is basically the same as that shown in FIG. 2, except that one of the microphones has been eliminated, and no array is indicated, as there is only one microphone 710. This embodiment can be used for a transducer with enhanced privacy, but without the rejection of acoustic background noise provided with an array of two or more microphones. In this case, the loudspeaker 712 is controlled to significantly reduce the pressure signal p measured at that lone microphone 710. Thus, the above discussion is applicable, but $p_t$ is equal to p. However, the discussion regarding reducing or minimizing $p_t$=p is applicable. It is not possible to measure the derivative of the pressure, because there is only one microphone. The signal to be transmitted would be taken from the signal provided to the loudspeaker 712. Such a system provides some privacy (reduction of radiated sound, RS) but would not reject ambient noise (because p alone has no directional sensitivity).

It is also possible to provide one or more user operated controls that allow the user to manually change the loudspeaker output signal, to improve upon performance, either regarding radiated sound or immunity from ambient background noise, or both. Such a control can be a simple amplitude control, or it might also provide control over the phase, and even may be frequency specific for amplitude and phase. In particular, it could also allow changing the proportionality factor for the loudspeaker, as compared to the talker alone. The mechanism can be a wheel or two direction hold down switch.

As mentioned above, a theoretical basis for inventions disclosed herein is that one can enhance acceleration between the talker and the loudspeaker, and thereby reduce radiated sound. To do so requires knowing something about acceleration of the sound medium particles in the region between the talker and the loudspeaker. Much of the above discussion pertains to using an array of pressure sensors to estimate a derivative of sound pressure, and from that estimated derivative, to infer acceleration, based on the proportional relation between pressure derivative and air particle acceleration.

As has been mentioned, rather than using pressure sensors, to get the acceleration, one can measure acceleration directly. In that case, an acceleration sensor such as a laser doppler sensor could be used. This can be a single acceleration sensor, or an array of acceleration sensors. If an acceleration sensor or sensors is used, the above equations can be used to determine the appropriate signal to drive the loudspeaker. The goal is still to enhance acceleration, and to reduce pressure attributable to the talker. It is not necessary to use two pressure sensors to estimate a derivative. More than one pressure sensor are still used to establish directional sensitivity with respect to acoustic background noise. With the system that makes a direct measurement of the acceleration, it is still useful to use two or more microphones for directional sensitivity. Comparison of a $p_t$ to a threshold $\epsilon$ is still made. The signal that drives the loudspeaker is proportional to acceleration. There remain two choices for what signal to transmit, those being the input to the loudspeaker and the acceleration measured by the acceleration sensor.

The foregoing discussion has been largely limited to transducing human speech with a frequency range of between approximately 200 to approximately 3000 Hz. However, the same principals can be applied to transducing other sound production. For instance, if it is desired to transduce very low frequency acoustic waves, such as whale sound production, while achieving the other goals of the inventions hereof, namely not being sensitive to background noise, and reducing radiation of the sound being produced by the subject, then a much lower frequency range, or lower limit would apply, as can be implemented by a person of ordinary skill in the art. Conversely, if sound production at a higher frequency range, such as the sounds produced by bats, is of interest, then the range would extend to much higher, as appropriate.

There may also be other applications where the source of interest to be transduced and transmitted, without interference from acoustic background noise, and without generating sound that radiates away from the source, is not a talker. Such other sources include animals, such as whales and bats, or any acoustic source that it is desired to monitor. Thus, as the word talker is used herein and in the claims, it will be understood to also mean, if appropriate, any such source that is desired to be transduced. Thus, the word talker can be considered to be interchangeable with the phrase acoustic source, in general.

Using a local loudspeaker to enhance output of a pressure transducer, or acceleration sensor, is an invention hereof.

It is also of interest to note that wavelengths of sound transmitted in other media, such as water, may be generally longer than their counterparts for the same frequency in air. Thus, an apparatus that embodies the principles of inventions hereof to be used in water need not have its components located as closely to each other as would an apparatus for use in air, to have the components spaced closer than ⅙-⅓ the smallest wavelength of interest.

Partial Summary

A new transducer is disclosed herein for sensing sounds produced by a talker by measuring the acceleration of the air at the transducer. Further, enhancement of this acceleration is accompanied by reduction of the portion of the sound energy that escapes from the regions around the transducer. The result is a high sensitivity transducer, with increased privacy as a result of the reduction in radiated sound, with significant advantages for use in communication systems, especially cell phones and in a multi-person office environment. A pressure sensor array with a weighted output is designed to as much as possible be sensitive to sound from a source talker only, and not to acoustic background noise, and not to a loudspeaker. The weighted signal is a talker sum pressure signal. The array also produces a signal (using a different weighting) that corresponds to an estimate of a derivative of pressure. The derivative signal is proportional to the volume velocity fluctuations produced by the source. This signal is enhanced, rather than reduced, by other operations of the transducer. Thus, it is a strong signal. The other operations are that a loudspeaker is driven to make the talker sum pressure signal that corresponds to the source talker as small as desired. In order to do that, it must be that the loudspeaker is being driven such that the volume velocity fluctuations produced by the loudspeaker are approximately equal and opposite to the volume velocity fluctuations produced by the source talker. Thus, no compression of the air arises, and no sound is radiated into the far field. All of this happens because the system is driven to reduce the talker pressure sum signal to below a desired threshold. It is not necessary to directly measure the volume velocity fluctuations of the talker source.

Rather than a talker, the inventions disclosed herein can be used with other acoustic sources, including animals, such as whales, birds and bats, speakers and singers with microphones and public address systems, etc.

Inventions disclosed and described herein include apparatus for transducing speech and transmitting that speech to a distant location, such as by telephone or radio, while also producing a local acoustic signal, or sound waves, that enhance the privacy of the talker by reducing the radiation of sound from the talker. Within the apparati disclosed are subcombinations of elements that may be distinct inventions. Also disclosed are methods for transducing speech and other acoustic signals, and generating a high quality signal for transmission that is relatively immune to acoustic background noise, and which does not radiate in the local environment in which it is produced.

Thus, this document may disclose several related inventions.

One invention disclosed herein is an apparatus for transducing an acoustic signal produced by a source, the signal having a frequency within a range from a low to a high, and corresponding wavelength within a range from a long to a short. The apparatus comprises: an array of at least two pressure sensors spaced apart along a sensor axis and located at an array location; and a loudspeaker that is configured to output sound waves in response to an input, at a loudspeaker location that is on the sensor axis. A first signal processor, coupled to an output from the array of pressure sensors, is configured to generate a signal that corresponds to an estimate of a pressure derivative approximately along the sensor axis, at the array location. A second signal processor, having an input that is coupled to an output of the first signal processor, and having an output that is coupled to the loudspeaker input, is configured to generate an output signal that is proportional to the estimate of derivative signal.

Such an apparatus may further comprise: a third signal processor, coupled to an output from the array of pressure sensors, configured to generate a signal that corresponds to a weighted source pressure sum; and a comparator, coupled to an output of the third signal processor that generates the weighted pressure sum signal, configured to generate a pressure sum error signal that corresponds to whether the pressure sum signal is less than a threshold signal $\epsilon$. A fourth signal processor, coupled to an output of the comparator, is configured to generate a coefficient signal based on the pressure sum error signal, which coefficient signal is input to the second signal processor, which is further configured to generate an output signal that is proportional to the estimate of derivative signal, with a proportionality that is based on the coefficient signal.

For a related variation, the fourth signal processor is configured to generate a coefficient signal that results in the pressure sum being no greater than the threshold signal $\epsilon$. The pressure sum may be a sum of equally or unequally weighted outputs of sensors of the array. The weighting may also be a frequency based weighting.

In accord with a related embodiment, the weighted pressure sum is chosen to establish a directional sensitivity to the pressure sensor array to discriminate in favor of sound coming from the direction of the source input portion. The directional sensitivity may be any suitable superdirective sensitivity, such as a cardioid, or such as is illustrated with reference to FIG. 12.

According to a typical embodiment, for most cases, there is a source input portion, the pressure sensor array and loudspeaker being arranged such that the loudspeaker is more distant from the source input portion than is the array. It is beneficial that the sensors of the array be located close enough to each other that inertial effects of the medium dominate the pressure difference between elements. This distance is no more than approximately ⅓ of a wavelength of the shortest wavelength of interest, and preferably no more than ⅙ of a wavelength. It is also beneficial for the loudspeaker to be within this distance from the sensor array. It is beneficial, although not as important, for the source/talker input portion (and thus the source/talker, when in use) to be within this distance from the sensor array.

According to still another embodiment, the apparatus is configured such that the signal generated by the second signal processor is also such that while a source produces sound waves at the source input portion, any sound pressure that radiates away from the source and apparatus is less than sound pressure that would be radiated away, attributable to the source alone, in the absence of the loudspeaker. Preferably, the sound pressure that radiates away from the source is related to the sound pressure relative to the talker alone approximately as shown with reference to FIG. 13, which represents a nearly ideal case. Thus, in general, the sound that radiates away from the combination of an invention hereof may be more than that shown in FIG. 13, but still less than that which would radiate away from a talker, or other source, alone. Perhaps more concretely, the signal generated by the second signal processor also is such that any sound pressure that radiates away between 1 and 10 feet (10.5 cm and 3.0 m) from the source and apparatus is less than would be any radiated sound pressure attributable to the source alone, in the absence of the loudspeaker, at corresponding distances.

Yet another embodiment of an invention hereof is an apparatus as stated above, in which the second signal processor is configured to generate a signal to drive the loudspeaker to draw in volume velocity fluctuations approximately equal to any volume velocity fluctuations produced by a source alone.

Still another embodiment of an invention hereof has the signal generated by the second signal processor also being such that a magnitude of the pressure derivative along the array axis at the array exceeds that which would be attributable to the source alone, in the absence of the loudspeaker.

For a commonly useful embodiment, the pressure sensors are microphones.

According to another embodiment, for use in water or other liquid, the pressure sensors may be hydrophones.

Typically, with many embodiments, the loudspeaker outputs sound waves that are out of phase relative to the source.

It is helpful for some embodiments that the pressure sensors output be sampled at a frequency greater than approximately 2.4 times the high frequency of the range and in cases establishing a superdirectivity greater than approximately 6 times the highest frequency of the range.

A frequency range of great interest is that of human speech, which is between approximately 200-3000 Hz.

According to one embodiment, an output of the apparatus is taken from the input to the loudspeaker. According to another embodiment, an output is taken from the output of the processor that generates an estimate of sound pressure derivative.

According to various embodiments, the output may be coupled to a telephone signal generator, either a land-line, or a cellular telephone signal generator, or a radio frequency signal generator, or a wireless or wired microphone that is part of a public address system.

Some preferred embodiments include a shroud to improve performance in the presence of turbulence. Others may include a user operable control, to vary the amplitude or the phase of the loudspeaker output, relative to the source, together or separately.

Still another embodiment, more specifically characterized for use as a telephone, is a telephone handset for transducing a talker's speech, into a telephone transmission, the handset comprising: a housing having a talker signal input portion; an array of at least two pressure sensors, spaced apart along a sensor axis that passes through the talker signal input portion, arranged at an array location; and a loudspeaker at a loudspeaker location that is on the sensor axis and more distant from the talker signal input portion than it is from the array location. A first signal processor, coupled to an output from the array of pressure sensors, is configured to generate a signal that corresponds to an estimate of a pressure derivative approximately along the sensor axis, at the array location. A second signal processor, having an input that is coupled to an output of the signal processor that generates an estimate of derivative signal, and having an output that is coupled to the loudspeaker input, is configured to generate an output signal that is proportional to the estimate of derivative signal.

A related telephone embodiment also includes: a third signal processor, coupled to an output from the array of pressure sensors, configured to generate a signal that corresponds to a weighted talker pressure sum; and a comparator, coupled to an output of the third signal processor that generates the weighted pressure sum signal, configured to generate a pressure sum error signal that corresponds to whether the pressure sum signal is less than a threshold signal $\epsilon$. A fourth signal processor, coupled to an output of the comparator, is configured to generate a coefficient signal based on the pressure sum error signal, which coefficient signal is input to the second signal processor, which is further configured to generate an output signal that is proportional to the estimate of derivative signal, with a proportionality that is based on the coefficient signal.

In manners similar to that mentioned above for more generally described embodiments, the fourth signal processor of a telephone embodiment may also be configured to generate a coefficient signal that results in the pressure sum being no greater than the threshold signal $\epsilon$. The pressure sum may be weighted, equally or unequally, and frequency dependent. Further, any weightings may be set to establish a directive sensitivity that discriminates in favor of sound coming from the direction of the talker, by a supersensitivity, such as a cardioid, or as shown in FIG. 12.

According to many telephonic embodiments, the handset includes a talker input portion, a sensor array, and a loudspeaker, all along a sensor axis, with the array located between the input portion and the loudspeaker, and with the relevant elements spaced from each other within ⅓, or preferably ⅙ of the smallest wavelength of interest. The frequency range of interest is that of human speech.

With a particularly advantageous embodiment, the handset is configured such that the signal generated by the second signal processor is such that while a talker speaks at the talker input portion, any sound pressure that radiates away from the talker and handset is less than pressure that would be radiated away, attributable to the talker alone, in the absence of the loudspeaker. In an ideal case, the degree of reduction in radiated sound approaches that illustrated with reference to FIG. 13. In general, the signal generated by the second signal processor is such that any sound pressure that radiates away between 1 and 10 feet (10.5 cm and 3.0 m) from the talker and handset is less than would be any radiated sound pressure attributable to the talker alone, in the absence of the loudspeaker, at corresponding distances.

According to still another embodiment of a handset invention, the signal generated by the second signal processor also is such that results in a magnitude of the pressure derivative along the array axis at the array exceeding what would be a magnitude of a pressure derivative along the array axis at the array attributable to the talker alone.

For yet another telephone embodiment of an invention hereof, the second signal processor is configured to generate a signal to drives the loudspeaker to draw in volume velocity fluctuations approximately equal to any volume velocity fluctuations produced by a talker alone.

Any of the foregoing telephone embodiments may have their output signal that is to be transmitted taken from the input to the loudspeaker, or from a signal processor that generates an estimate of pressure derivative from inputs from the microphone array. They may also include a shroud, and/or a user operable magnitude and phase control for the loudspeaker.

Another embodiment that is preferred is an apparatus for transducing an acoustic signal produced in an acoustic medium by a source, the apparatus comprising: an acceleration sensor, located at a sensor location, arranged to sense acceleration of the medium, along a line and to generate a signal that corresponds to acceleration of the acoustic medium along the line; a loudspeaker at a loudspeaker location that is spaced from the sensor location along the line; and an amplifying signal processor, having an input that is coupled to the acceleration sensor, which amplifying signal processor is coupled to an input of the loudspeaker, and configured to generate an output signal that is proportional to the acceleration signal.

The acoustic medium acceleration sensor may comprise any suitable sensor, such as a laser Doppler' sensor or an array of pressure sensors and a derivative sum signal processor, coupled to the array, configured to generate a signal that is proportional to an estimate of a derivative of pressure along the line.

If an acceleration sensor is used, this embodiment may also comprise: an array of at least two pressure sensors spaced apart along a sensor axis and located at an array location that is spaced from the loudspeaker location along the line; and a sum signal processor, coupled to an output from the array of pressure sensors, configured to generate a signal that corresponds to a weighted source pressure sum. A comparator, coupled to an output of the sum signal processor that generates the weighted pressure sum signal, is configured to generate a pressure sum error signal that corresponds to whether the pressure sum signal is less than a threshold signal $\epsilon$. A coefficient signal processor, coupled to an output of the comparator, is configured to generate a coefficient signal based on the pressure sum error signal, which coefficient signal is input to the amplifying signal processor, which is further configured to generate an output signal that is proportional to the estimate of derivative signal with a proportionality that is based on the coefficient signal. If an array of pressure sensors is used to sense acceleration, then that same array can be used also as described in this paragraph, typically with different weightings.

A variation of an acceleration measuring embodiment is further configured such that the signal generated by the amplifying signal processor also is such that while a source generates sound at the source input portion, any sound pressure that radiates away from the source and apparatus is less than sound pressure that would be radiated away, attributable to the source alone, in the absence of the loudspeaker. FIG. 13 shows approximately a best case that can be achieved, and variations of this embodiment may achieve similar results, to a lesser degree.

Still another embodiment described in terms of measuring acceleration has an amplifying signal processor also configured such that the medium acceleration along the line exceeds what would be a magnitude of medium acceleration along the line attributable to the source alone, in the absence of the loudspeaker.

It is also an embodiment described in terms of measuring acceleration, where the amplifying signal processor is configured to generate a signal to drive the loudspeaker to draw in volume velocity fluctuations approximately equal to any volume velocity fluctuations produced by a source alone.

The sensors that measure pressure can be microphones or hydrophones or any appropriate pressure transducer.

Still another preferred embodiment of inventions hereof is an apparatus for transducing an acoustic signal produced by a source, the signal having a frequency within a range from a low to a high, and corresponding wavelength within a range from a long to a short, the apparatus comprising: an array of at least two pressure sensors spaced apart along a sensor axis and located at an array location; and a loudspeaker, at a loudspeaker location that is on the sensor axis. A first signal processor, coupled to an output from the array of pressure sensors, is configured to generate a signal that corresponds to an estimate of a pressure derivative approximately along the sensor axis, at the array location. A second signal processor, having an input that is coupled to an output of the first signal processor that generates an estimate of pressure derivative signal, and having an output that is coupled to the loudspeaker input, is configured to generate an output signal that causes the loudspeaker to draw in approximately any volume velocity fluctuations that are produced by the source.

Such an apparatus that draws in approximately equal volume velocity fluctuations may further comprise: a third signal processor, coupled to an output from the array of pressure sensors, configured to generate a signal that corresponds to a weighted source pressure sum; and a comparator, coupled to an output of the third signal processor that generates the weighted pressure sum signal, configured to generate a pressure sum error signal that corresponds to whether the pressure sum signal is less than a threshold signal $\epsilon$. A fourth signal processor, coupled to an output of the comparator, is configured to generate a coefficient signal based on the pressure sum error signal, which coefficient signal is input to the second signal processor, which is further configured to generate an output signal that is proportional to the estimate of derivative signal with a proportionality that is based on the coefficient signal.

Variations on this embodiment that draws in approximately equal volume velocity fluctuations include similar variations to those discussed above, such as means for comparing a source pressure sum to a threshold $\epsilon$, using equal, or unequal weightings, arranging all such that sound radiating away from the apparatus is less than that which would radiate away from a talker alone, etc.

Still another preferred embodiment is an apparatus for transducing an acoustic signal produced by a source, comprising: an array of at least two pressure sensors spaced apart along a sensor axis and located at an array location; a loudspeaker that is on the sensor axis; and a first signal processor, coupled to an output from the array of pressure sensors, configured to generate a signal that corresponds to an estimate of a pressure derivative approximately along the sensor axis, at the array location. A second signal processor, having an input that is coupled to an output of the first signal processor that generates an estimate of pressure derivative signal, and having an output that is coupled to the loudspeaker input, is configured to generate an output signal that causes the loudspeaker to generate a signal which, in combination with the source signal, approximates an acoustic dipole.

Even another preferred embodiment is an apparatus for transducing sound produced by a source at a source location, comprising: at least one sensor for measuring an acoustic parameter that corresponds to the sound produced by the source, and generating a signal that corresponds to the measurement; a plurality of sensors for measuring a second acoustic parameter in a plurality of instances, and generating signals that correspond to each instance. A signal processor is configured to generate a weighted combination of the signals that correspond to each instance of the second parameter, the weighting being chosen to establish a directional acoustic sensitivity that discriminates in favor of sound coming from the direction of the source location. There is also means for controllably, variably, augmenting the first acoustic parameter to reduce the second acoustic parameter below a threshold.

A related embodiment to that just mentioned is an apparatus for transducing sound produced by a talker comprising: an array of at least two pressure sensors spaced apart along a sensor axis and located at an array location; a loudspeaker, at a loudspeaker location that is on the sensor axis; and a signal processor, coupled to an output from the array of pressure sensors, configured to generate a signal that corresponds to an estimate of pressure derivative, approximately along the sensor axis, at the array location. A signal processor, coupled to an output from the array of pressure sensors, is configured to generate a signal that corresponds to a weighted sum of an acoustic parameter at the array location, the weighting chosen to establish a directional sensitivity to the pressure sensor array to discriminate in favor of sound coming from the direction of the talker. A comparator, coupled to an output of the signal processor that generates a weighted sum signal, is configured to generate an error signal that corresponds to a difference between the weighted sum of the acoustic parameter and a threshold $\epsilon$. A signal processor is configured to generate a coefficient signal based on the error signal, which coefficient signal is input to a signal generator. The signal generator is coupled to an output of the comparator, and an output of the signal processor that generates an estimate of derivative signal. The signal generator is also coupled to an input of the loudspeaker, and is configured to generate an output signal that: is proportional to the derivative signal with a degree of proportionality that is based on the coefficient signal; and results in the weighted sum of the acoustic parameter being no greater than the threshold $\epsilon$.

A final preferred apparatus embodiment is an apparatus for transducing an acoustic signal produced by a source, comprising: a pressure sensor located at a sensor location, on a sensor line from a source input portion, which sensor is configured to generate a signal that is proportional to sound pressure; and a loudspeaker at a loudspeaker location that is on the sensor line. A first signal processor, has an input that is coupled to the pressure sensor and an output signal that is proportional to the pressure signal. The output signal is coupled to: the loudspeaker input; and a comparator, configured to generate a pressure error signal that corresponds to whether the pressure signal is less than a threshold signal $\epsilon$. A second signal processor, coupled to an output of the comparator, is configured to generate a coefficient signal based on the pressure error signal, which coefficient signal is input to the first signal processor, which is further configured to generate an output signal that is proportional to the pressure signal with a proportionality that is based on the coefficient signal.

Turning now to preferred embodiments of methods of inventions hereof, one is a method for transducing an acoustic signal produced in an acoustic medium by a source at a source location, the signal having a frequency within a range from a low to a high, and corresponding wavelength within a range from long to short. The method comprises the steps of: measuring sound pressure at at least two locations along a sensor axis that passes through the source location, at an array location, spaced from the source location; based on the measured sound pressure, estimating a sound pressure derivative along the sensor axis at the array location, and generating a signal that is proportional thereto. The method also comprises driving a loudspeaker, located on the sensor axis, spaced away from the source location farther than is the array location, with a signal that is proportional to the estimated sound pressure derivative signal.

The step of measuring sound pressure may comprise measuring sound pressure with an array of at least two pressure transducers.

A further preferred embodiment includes the steps of generating a signal that comprises a source pressure sum of outputs from the array of pressure sensors; and generating a coefficient signal, based on the source pressure sum signal. The step of driving the loudspeaker comprises driving the loudspeaker with a signal having a degree of proportionality relative to the estimated pressure derivative, that is based on the source pressure sum signal.

With this embodiment, the step of generating a signal that comprises a source pressure sum may comprise generating a weighted source pressure sum of outputs from the array of pressure sensors, further comprising the steps of: comparing the weighted source pressure sum to a threshold signal $\epsilon$; generating a pressure sum error signal that corresponds to whether the pressure sum signal is less than the threshold signal; and generating a coefficient signal, based on the pressure sum error signal. The step of driving the loudspeaker comprises driving the loudspeaker with a signal having a degree of proportionality relative to the estimated pressure derivative, that is based on the pressure sum error signal.

The step of generating a weighted source pressure sum may use equal or unequal weightings, or frequency dependent weightings.

The step of generating a coefficient signal may comprise generating a coefficient signal that causes the loudspeaker to be driven such that the pressure sum signal is less than the threshold signal.

With the foregoing, the step of generating an unequally weighted source pressure sum may comprise generating a source pressure sum chosen to establish a directional sensitivity to the pressure sensor array to discriminate in favor of sound coming from the direction of the source location. The directional sensitivity may be a superdirectivity, such as a cardioid, or such as is illustrated with reference to FIG. 12.

According to a related embodiment, the step of driving a loudspeaker further comprises driving a loudspeaker with a signal that results in any total sound pressure that radiates away from the source and loudspeaker being reduced to less than any sound pressure that would be radiated, attributable to the source alone, in the absence of the loudspeaker. In an ideal case, the degree to which radiated sound is reduced is illustrated with reference to FIG. 13, which gives an idea of the interplay among the parameters that govern such reduction and the maximum reduction that can be achieved.

Still another related embodiment of a method hereof comprises the step of driving a loudspeaker with a signal that results in a magnitude of the pressure derivative along the sensor axis at the array location exceeding that which would be attributable to the source alone, in the absence of the loudspeaker.

With a further related embodiment of a method hereof, the step of driving the loudspeaker comprises driving the loudspeaker with a signal that causes the loudspeaker to draw in volume velocity fluctuations approximately equal to any volume velocity fluctuations produced by the source alone.

According to yet another preferred embodiment of a method hereof, the step of driving a loudspeaker further comprises driving the loudspeaker with a signal that causes the loudspeaker to generate sound waves which, in combination with any source signal, approximates an acoustic dipole.

It is helpful according to all embodiments hereof that any step of measuring sound pressure comprise sampling sound pressure at a frequency greater than approximately 2.4 times the high frequency of the range and in some cases, greater than approximately 6 times.

Also, in connection with all method embodiments having an estimated derivative signal, there may be a step of generating, as an electronic output signal, a signal that is proportional to the estimated sound pressure derivative signal.

According to various method embodiments hereof, there may be a step of generating an electronic output signal that may be a telephone signal, a cellular telephone signal, a radio frequency signal, or an electronic signal that is locally transmitted, such as by wireless or wired microphone to an amplifier.

Another embodiment of an invention hereof is a method for transducing an acoustic signal produced in an acoustic medium by a specific acoustic source, namely a talker, the method comprising the steps of: measuring sound pressure at at least two locations along a sensor axis that passes through the talker location, at an array location, spaced from the talker location; and based on the measured sound pressure, estimating a sound pressure derivative along the sensor axis at the array location, and generating a signal that is proportional thereto. The method further comprises driving a loudspeaker, located on the sensor axis, spaced away from the source location farther than is the array location, with a signal that is proportional to the estimated sound pressure derivative signal.

All of the variations of the more generally stated method for transducing a signal from a source, are appropriate variations of the embodiment for transducing a signal from a talker.

Another embodiment of an invention hereof is a method for transducing an acoustic signal produced in an acoustic medium by a source at a source location, comprising the steps of: measuring acceleration of the acoustic medium along a line that passes through the source location, at a sensor location, spaced from the source location; and generating a signal that is proportional to the measured acceleration. Also part of this method is driving a loudspeaker, located on the sensor axis, spaced away from the source location farther than is the array location, with a signal that is proportional to the acceleration signal.

With this method, the step of measuring acceleration may comprise the steps of: using an array of at least two pressure sensors arranged along the line generating signals that correspond to pressure; and processing the signals that correspond to pressure to generate a signal that corresponds to an estimate of a derivative of pressure along the line.

Alternatively, the step of measuring acceleration may comprise using a laser Doppler transducer.

A related method further includes using an array of at least two pressure sensors (which may be the same as any array used to establish acceleration) spaced apart along a sensor axis that is collinear with the line, and located at an array location that is spaced from the loudspeaker location along the line, and generating a signal that corresponds to a weighted source pressure sum of outputs from the at least two sensors. The method further comprises comparing the weighted source pressure sum to a threshold signal e and, based on the comparison, generating a pressure sum error signal that corresponds to whether the pressure sum signal is less than the threshold. A coefficient signal is generated, based on the pressure sum error signal. The method also includes generating an output signal that is proportional to the estimate of derivative signal, with a proportionality that is based on the coefficient signal.

In this method the step of driving the loudspeaker further may comprise driving the loudspeaker such that while a source generates sound, any sound pressure that radiates away from the source and the loudspeaker together is less than sound pressure that would be radiated away, attributable to the source alone.

Also with this method, the step of driving the loudspeaker further comprises driving the loudspeaker such that while a source generates sound, a magnitude of the medium acceleration along the line exceeds what would be a magnitude of medium acceleration along the line attributable to the source alone.

In addition, in this method the step of driving the loudspeaker further comprises driving the loudspeaker to draw in volume velocity fluctuations approximately equal to any volume velocity fluctuations produced by a source alone.

In any variation of this or any other method hereof, if appropriate, pressure may be measured by a microphone or a hydrophone, or other pressure transducer.

Still one more embodiment of an invention hereof is a method for transducing an acoustic signal produced in an acoustic medium by a source comprising the steps of: measuring, at a sensor location spaced from the talker location, one of: a sound pressure derivative along a sensor axis; and acceleration of the acoustic medium along a sensor axis. The method also includes the step of driving a loudspeaker at a loudspeaker location on the sensor axis, spaced from the talker location farther away than is the sensor location, with a signal that is proportional to the one of a sound pressure derivative and acceleration of the acoustic medium, to draw in substantially all volume velocity fluctuations that are produced by the source.

With this embodiment, the step of driving the loudspeaker may comprise the steps of: at the sensor location, measuring a sound pressure sum arriving at the sensor location from a direction of the source location; and repeatedly adjusting the degree of proportionality while the pressure sum is greater than a predetermined threshold.

In a similar but different embodiment, an invention hereof is a method for transducing an acoustic signal produced in an acoustic medium by a source comprising the steps of: measuring, at a sensor location spaced from the talker location, one of: a sound pressure derivative along a sensor axis; and acceleration of the acoustic medium along a sensor axis. The method further includes driving a loudspeaker at a loudspeaker location on the sensor axis spaced from the talker location farther away than is the sensor location, with a signal that is proportional to the one of a sound pressure derivative and acceleration of the acoustic medium, such that, in combination, the loudspeaker and the source approximate an acoustic dipole.

The step of driving the loudspeaker may comprise the steps of: at the sensor location, measuring a sound pressure sum arriving at the sensor location from a direction of the source location; and repeatedly adjusting the degree of proportionality while the pressure sum is greater than a predetermined threshold.

A final invention hereof is a method of transducing an acoustic parameter comprising the steps of measuring the acoustic parameter with an array that has a directional sensitivity, which directional sensitivity is established by another acoustic parameter, which is reduced, and in some cses even minimized, by other steps of the method.

Many techniques and aspects of the inventions have been described herein. The person skilled in the art will understand that many of these techniques and aspects can be used with other disclosed techniques and aspects, even if they have not been specifically described in use together. For instance, the apparatus may be configured and methods may be conducted such that one or all, or any combination of the following are present or occur: loudspeaker draws in volume velocity fluctuations approximately equal to that produced by source; loudspeaker acts, in combination with source, as an approximate acoustic dipole; loudspeaker and source, in combination, radiate less total sound pressure into the near and far field than would the source alone; acceleration along a line between the loudspeaker and the talker is enhanced relative to the source alone; derivative of pressure along the line is also enhanced; pressure is reduced at the sensor array, as compared to the source alone; inertial effects dominate.

In several cases, an ideal degree of an effect has been discussed, such as the degree of reduction in radiation shown with reference to FIG. 13, or that an approximate acoustic dipole is generated, or that inertial effects dominate. It will be understood that the mention in the disclosure of a parameter limit, such as the spacing between components being less than ⅙ of a wavelength, or the degree of reduction in radiated sound approximating that shown in FIG. 13, etc., are ideals, and that the inventors consider apparatus and methods to be an invention hereof if they embody the elements and steps as claimed, even if they do not meet these ideals, to the degree permitted by pertinent prior art.

In general, most, if not all of the discussion that has been specific to human speech and telephonic devices and methods is generally applicable to any acoustic source operating in any medium, whether compressible or incompressible, and is considered to be an invention hereof, even if only described in connection with a talker and a telephone.

Various functions and steps have been discussed as being performed by a signal processor or a signal generator. However, it may be that it is reasonable to combine all processing functions within a single processor, and that is also considered to be included in the description of the individual processors mentioned. Also, conversely, operations that are discussed as being conducted in a single processor may theoretically be performed in more than one processor, whose outputs are combined and directed such that they operate in consort. This also is considered to be included in the description of individual processors with discrete functions. Rather than processors, perse, hardwired, dedicated circuits may be developed to achieve many of the functions described herein, and those too are considered to be included within the rubric of processor.

This disclosure describes and discloses more than one invention. The inventions are set forth in the claims of this and related documents, not only as filed, but also as developed during prosecution of any patent application based on this disclosure. The inventors intend to claim all of the various inventions to the limits permitted by the prior art, as it is subsequently determined to be. No feature described herein is essential to each invention disclosed herein. Thus, the inventors intend that no features described herein, but not claimed in any particular claim of any patent based on this disclosure, should be incorporated into any such claim.

Some assemblies of hardware, or groups of steps, are referred to herein as an invention. However, this is not an admission that any such assemblies or groups are necessarily patentably distinct inventions, particularly as contemplated by laws and regulations regarding the number of inventions that will be examined in one patent application, or unity of invention. It is intended to be a short way of saying an embodiment of an invention.

An abstract is submitted herewith. It is emphasized that this abstract is being provided to comply with the rule requiring an abstract that will allow examiners and other searchers to quickly ascertain the subject matter of the technical disclosure. It is submitted with the understanding that it will not be used to interpret or limit the scope or meaning of the claims, as promised by the Patent Office's rule.

The foregoing discussion should be understood as illustrative and should not be considered to be limiting in any sense. While the inventions have been particularly'shown and described with references to preferred embodiments thereof, it will be understood by those skilled in the art that various changes in form and details may be made therein without departing from the spirit and scope of the inventions as defined by the claims.

The corresponding structures, materials, acts and equivalents of all means or step plus function elements in the claims below are intended to include any structure, material, or acts for performing the functions in combination with other claimed elements as specifically claimed.

The invention claimed is:

1. An apparatus for transducing an acoustic signal produced by a source, the signal having a frequency within a range from a low to a high, and corresponding wavelength within a range from a long to a short, the apparatus comprising:

a. an array of at least two pressure sensors spaced apart along a sensor axis and located at an array location;

b. a loudspeaker that is configured to output sound waves in response to an input, at a loudspeaker location that is on the sensor axis;

c. a first signal processor, coupled to an output from the array of pressure sensors, configured to generate a signal that corresponds to an estimate of a pressure derivative approximately along the sensor axis, at the array location;

d. a second signal processor, having an input that is coupled to an output of the first signal processor, and having an output that is coupled to the loudspeaker input, which second signal processor is configured to generate an output signal that is proportional to the estimate of derivative signal;

e. a third signal processor, coupled to an output from the array of pressure sensors, configured to generate a signal that corresponds to a weighted source pressure sum;

f. a comparator, coupled to an output of the third signal processor that generates the weighted pressure sum signal, configured to generate a pressure sum error signal that corresponds to whether the pressure sum signal is less than a threshold signal $\epsilon$; and g. a fourth signal processor, coupled to an output of the comparator, configured to generate a coefficient signal based on the pressure sum error signal, which coefficient signal is input to the second signal processor which is further configured to generate an output signal that is proportional to the estimate of derivative signal, with a proportionality that is based on the coefficient signal.

2. The apparatus of claim 1, the fourth signal processor configured to generate a coefficient signal that results in the pressure sum being no greater than the threshold signals $\epsilon$.

3. The apparatus of claim 1, the fourth signal processor coupled to an output of the array further configured to generate the signal that corresponds to pressure sum as a sum of equally weighted outputs of sensors of the array.

4. The apparatus of claim 1, the fourth signal processor coupled to an output of the array further configured to generate the signal that corresponds to pressure sum as a sum of unequally weighted outputs of sensors of the array.

5. The apparatus of claim 4, further comprising a source input portion, the pressure sensor array and loudspeaker arranged such that the loudspeaker is more distant from the source input portion than is the array, the weighted pressure sum being chosen to establish a directional sensitivity to the pressure sensor array to discriminate in favor of sound coming from the direction of the source input portion.

6. The apparatus of claim 5, the weighted pressure sum being chosen to establish a cardioid directional sensitivity.

7. The apparatus of claim 5, the array comprising an array of three sensors, the weighted pressure sum being chosen to establish a superdirectivity substantially as shown in FIG. 12.

8. The apparatus of claim 5, the array comprising an array of at least two sensors, the weighted pressure sum being chosen to establish a superdirectivity.

9. The apparatus of claim 5, the weighted pressure sum comprising a frequency dependent weighting.

10. A telephone handset for transducing a talker's speech, into a telephone transmission, the handset comprising:

a. a housing having a talker signal input portion;

b. an array of at least two pressure sensors, spaced apart along a sensor axis that passes through the talker signal input portion, arranged at an array location;

c. a loudspeaker at a loudspeaker location that is on the sensor axis and more distant from the talker signal input portion than it is from the array location;

d. a first signal processor, coupled to an output from the array of pressure sensors, configured to generate a signal that corresponds to an estimate of a pressure derivative approximately along the sensor axis, at the array location;

e. a second signal processor, having an input that is coupled to an output of the signal processor that generates an estimate of derivative signal, and having an output that is coupled to the loudspeaker input, which signal processor is configured to generate an output signal that is proportional to the estimate of derivative signal.

f. a third signal processor, coupled to an output from the array of pressure sensors, configured to generate a signal that corresponds to a weighted talker pressure sum;

g. a comparator, coupled to an output of the third signal processor that generates the weighted pressure sum signal, configured to generate a pressure sum error signal that corresponds to whether the pressure sum signal is less than a threshold signal $\epsilon$; and h. a fourth signal processor, coupled to an output of the comparator, configured to generate a coefficient signal based on the pressure sum error signal, which coefficient signal is input to the second signal processor which is further configured to generate an output signal that is proportional to the estimate of derivative signal with a proportionality that is based on the coefficient signal.

11. The handset of claim 10, the fourth signal processor configured to generate a coefficient signal that results in the pressure sum being no greater than the threshold signal $\epsilon$.

12. The handset of claim 10, the fourth signal processor coupled to an output of the array further configured to generate the signal that corresponds to pressure sum as a sum of equally weighted outputs of sensors of the array.

13. The handset of claim 10, the fourth signal processor coupled to an output of the array further configured to generate the signal that corresponds to pressure sum as a sum of unequally weighted outputs of sensors of the array.

14. The handset of claim 13, further comprising a talker input portion, the pressure sensor array and loudspeaker arranged such that the loudspeaker is more distant from the talker input portion than is the array, the weighted pressure sum being chosen to establish a directional sensitivity to the pressure sensor array to discriminate in favor of sound coming from the direction of the talker input portion.

15. The handset of claim 14, the weighted pressure sum being chosen to establish a cardioid directional sensitivity.

16. The handset of claim 14, the array comprising an array of three sensors, the weighted pressure sum being chosen to establish a superdirectivity substantially as shown in FIG. 12.

17. The handset of claim 14, the array comprising an array of at least two sensors, the weighted pressure sum being chosen to establish a superdirectivity.

18. The handset of claim 14, the weighted pressure sum comprising a frequency dependent weighting.

19. An apparatus for transducing an acoustic signal produced in an acoustic medium by a source, the signal having a frequency within a range from a low to a high, and corresponding wavelength within a range from a long to a short, the apparatus comprising:

a. an acceleration sensor, located at a sensor location, arranged to sense acceleration of the medium, along a line and to generate a signal that corresponds to acceleration of the acoustic medium along the line;

b. a loudspeaker that is configured to output sound waves in response to an input, at a loudspeaker location that is spaced from the sensor location along the line;

c. an amplifying signal processor, having an input that is coupled to the acceleration sensor, which amplifying signal processor is coupled to an input of the loudspeaker, and configured to generate an output signal that is proportional to the acceleration signal;

d. an array of at least two pressure sensors spaced apart along a sensor axis and located at an array location that is spaced from the loudspeaker location along the line;

e. a sum signal processor, coupled to an output from the array of pressure sensors, configured to generate a signal that corresponds to a weighted source pressure sum;

f. a comparator, coupled to an output of the sum signal processor that generates the weighted pressure sum signal, configured to generate a pressure sum error signal that corresponds to whether the pressure sum signal is less than a threshold signal $\epsilon$; and g. a coefficient signal processor, coupled to an output of the comparator, configured to generate a coefficient signal based on the pressure sum error signal, which coefficient signal is input to the amplifying signal processor, which is further configured to generate an output signal that is proportional to the estimate of derivative signal with a proportionality that is based on the coefficient signal.

20. The apparatus of claim 19, at least one of the pressure sensors comprising a microphone.

21. The apparatus of claim 19, at least one of the pressure sensors comprising a hydrophone.

22. An apparatus for transducing an acoustic signal produced by a source, the signal having a frequency within a range from a low to a high, and corresponding wavelength within a range from a long to a short, the apparatus comprising:

a. an array of at least two pressure sensors spaced apart along a sensor axis and located at an array location;

b. a loudspeaker that is configured to output sound waves in response to an input, at a loudspeaker location that is on the sensor axis;

c. a first signal processor, coupled to an output from the array of pressure sensors, configured to generate a signal that corresponds to an estimate of a pressure derivative approximately along the sensor axis, at the array location;

d. a second signal processor, having an input that is coupled to an output of the first signal processor that generates an estimate of pressure derivative signal, and having an output that is coupled to the loudspeaker input, which second signal processor is configured to generate an output signal that causes the loudspeaker to draw in any volume velocity fluctuations that are produced by the source;

e. a third signal processor, coupled to an output from the array of pressure sensors, configured to generate a signal that corresponds to a weighted source pressure sum;

f. a comparator, coupled to an output of the third signal processor that generates the weighted pressure sum signal, configured to generate a pressure sum error signal that corresponds to whether the pressure sum signal is less than a threshold signal $\epsilon$; and g. a fourth signal processor, coupled to an output of the comparator, configured to generate a coefficient signal based on the pressure sum error signal, which coefficient signal is input to the second signal processor which is further configured to generate an output signal that is proportional to the estimate of derivative signal with a proportionality that is based on the coefficient signal.

23. The apparatus of claim 22, the fourth signal processor configured to generate a coefficient signal that results in the pressure sum being no greater than the threshold signal $\epsilon$.

24. The apparatus of claim 22, the fourth signal processor coupled to an output of the array further configured to generate the signal that corresponds to pressure sum as a sum of unequally weighted outputs of sensors of the array.

25. An apparatus for transducing sound produced by a talker at a talker location, the apparatus comprising:

a. an array of at least two pressure sensors spaced apart along a sensor axis and located at an array location;

b. a loudspeaker, at a loudspeaker location that is on the sensor axis;

c. a signal processor, coupled to an output from the array of pressure sensors, configured to generate a signal that corresponds to an estimate of pressure derivative, approximately along the sensor axis, at the array location;

d. a signal processor, coupled to an output from the array of pressure sensors, configured to generate a signal that corresponds to a weighted sum of an acoustic parameter at the array location, the weighting chosen to establish a directional sensitivity to the pressure sensor array to discriminate in favor of sound coming from the direction of the talker location;

e. a comparator, coupled to an output of the signal processor that generates a weighted sum signal, configured to generate an error signal that corresponds to a difference between the weighted sum of the acoustic parameter and a threshold $\epsilon$;

f. a signal processor, coupled to an output of the comparator, configured to generate a coefficient signal based on the error signal, which coefficient signal is input to a signal generator that has an input that is coupled to an output of the signal processor that generates an estimate of derivative signal and an output that is coupled to the loudspeaker input, the signal generator being further configured to generate an output signal that:

i. is proportional to the derivative signal with a degree of proportionality that is based on the coefficient signal; and ii. results in the weighted sum of the acoustic parameter being no greater than the threshold $\epsilon$.

26. An apparatus for transducing an acoustic signal produced by a source, the signal having a frequency within a range from a low to a high, and corresponding wavelength within a range from a long to a short, the apparatus comprising:

a. a pressure sensor located at a sensor location, on a sensor line from a source input portion, which sensor is configured to generate a signal that is proportional to sound pressure;

b. a loudspeaker that is configured to output sound waves in response to an input, at a loudspeaker location that is on the sensor line;

c. a first signal processor, having an input that is coupled to the pressure sensor and having an output signal that is proportional to the pressure signal, which output signal is coupled to:

i. the loudspeaker input; and ii. a comparator, configured to generate a pressure error signal that corresponds to whether the pressure signal is less than a threshold signal $\epsilon$; and d. a second signal processor, coupled to an output of the comparator, configured to generate a coefficient signal based on the pressure error signal, which coefficient signal is input to the first signal processor, which is further configured to generate an output signal that is proportional to the pressure signal with a proportionality that is based on the coefficient signal.

27. A method for transducing an acoustic signal produced in an acoustic medium by a source at a source location, the signal having a frequency within a range from a low to a high, and corresponding wavelength within a range from long to short, the method comprising the steps of:

a. measuring acceleration of the acoustic medium, along a line that passes through the source location, at a sensor location, spaced from the source location;

b. generating a signal that is proportional to the measured acceleration;

c. driving a loudspeaker, located on the sensor axis, spaced away from the source location farther than the array location, with a signal that is proportional to the acceleration signal;

d. using an array of at least two pressure sensors spaced apart along a sensor axis that is collinear with the line, and located at an array location that is spaced from the loudspeaker location along the line;

e. generating a signal that corresponds to a weighted source pressure sum of outputs from the at least two sensors;

f. comparing the weighted source pressure sum to a threshold signal $\epsilon$ and, based on the comparison, generating a pressure sum error signal that corresponds to whether the pressure sum signal is less than the threshold;

g. generating a coefficient signal based on the pressure sum error signal; and h. generating an output signal that is proportional to the estimate of derivative signal, with a proportionality that is based on the coefficient signal.

* * * * *